US009300041B2

(12) United States Patent
Xu

(10) Patent No.: US 9,300,041 B2
(45) Date of Patent: Mar. 29, 2016

(54) MULTIMODE BROADBAND ANTENNA MODULE AND WIRELESS TERMINAL

(71) Applicant: Huawei Device Co., Ltd., Shenzhen (CN)

(72) Inventor: Huiliang Xu, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 200 days.

(21) Appl. No.: 14/145,441

(22) Filed: Dec. 31, 2013

(65) Prior Publication Data

US 2014/0111386 A1 Apr. 24, 2014

Related U.S. Application Data

(63) Continuation of application No. PCT/CN2012/083096, filed on Oct. 17, 2012.

(51) Int. Cl.
*H01Q 9/42* (2006.01)
*H01Q 5/01* (2006.01)
(Continued)

(52) U.S. Cl.
CPC ..... *H01Q 5/01* (2013.01); *H01Q 1/243* (2013.01); *H01Q 5/371* (2015.01); *H01Q 5/392* (2015.01); *H01Q 9/42* (2013.01)

(58) Field of Classification Search
CPC ..... H01Q 1/243; H01Q 9/42; H01Q 5/392; H01Q 5/371
USPC ..... 343/702, 825–829, 833, 834, 846; 455/575.7
See application file for complete search history.

(56) References Cited

U.S. PATENT DOCUMENTS 6,621,455 B2 9/2003 Wang et al.
6,650,294 B2 * 11/2003 Ying ..... H01Q 1/243 343/700 MS (Continued)

FOREIGN PATENT DOCUMENTS

CN 101174730 A 5/2008
CN 101557030 A 10/2009

(Continued)

OTHER PUBLICATIONS

Foreign Communication From a Counterpart Application, European Application No. 12879150.6, Extended European Search Report dated Sep. 12, 2014, 7 pages.

(Continued)

*Primary Examiner* — Michael C Wimer
(74) *Attorney, Agent, or Firm* — Conley Rose, P.C.; Grant Rodolph; Nicholas K. Beaulieu

(57) ABSTRACT

A multimode broadband antenna module and a wireless terminal are provided. The multimode broadband antenna module includes a printed circuit board and an antenna body, where the antenna body includes a first radiator and a second radiator that are electrically connected to the printed circuit board, where the first radiator includes a connection portion, a low frequency portion, and a high frequency portion, the second radiator includes a grounding portion, a low frequency portion, and a high frequency portion, and a first predetermined distance exists between the low frequency portion of the first radiator and the low frequency portion of the second radiator, and a second predetermined distance exists between the high frequency portion of the first radiator and the high frequency portion of the second radiator, so as to form a coupling capacitance effect between the first radiator and the second radiator.

4 Claims, 12 Drawing Sheets

(51) Int. Cl.

| | |
|---|---|
| ***H01Q 1/24*** | (2006.01) |
| ***H01Q 5/371*** | (2015.01) |
| ***H01Q 5/392*** | (2015.01) |

(56) References Cited

U.S. PATENT DOCUMENTS

| | | | | |
|---|---|---|---|---|
| 7,136,019 | B2 * | 11/2006 | Mikkola | H01Q 1/243 343/700 MS |
| 8,816,913 | B2 * | 8/2014 | Rhyu | H01Q 1/243 343/702 |
| 2003/0098812 | A1 | 5/2003 | Ying et al. | |
| 2004/0113845 | A1 | 6/2004 | Mikkola et al. | |
| 2007/0182636 | A1 | 8/2007 | Carlson | |
| 2008/0106473 | A1 | 5/2008 | Chung et al. | |
| 2012/0249386 | A1 | 10/2012 | Yanagi et al. | |
| 2012/0249393 | A1 | 10/2012 | Hotta et al. | |

FOREIGN PATENT DOCUMENTS

| | | | |
|---|---|---|---|
| CN | 201741791 | U | 2/2011 |
| CN | 102044748 | A | 5/2011 |
| CN | 102055065 | A | 5/2011 |
| CN | 102158245 | A | 8/2011 |
| EP | 1432072 | A1 | 6/2004 |
| EP | 2448065 | A1 | 5/2012 |
| EP | 2493012 | A1 | 8/2012 |
| EP | 2493015 | A1 | 8/2012 |
| JP | 2003347815 | A | 12/2003 |
| JP | 2012178810 | A | 9/2012 |
| WO | 2007000483 | A1 | 1/2007 |

OTHER PUBLICATIONS

Partial English Translation and Abstract of Chinese Patent Application No. CN102044748A, Part 1, Apr. 27, 2015, 4 pages.

Partial English Translation and Abstract of Chinese Patent Application No. CN102044748A, Part 2, Apr. 27, 2015, 2 pages.

Foreign Communication From a Counterpart Application, Chinese Application No. 201280003788.0, Chinese Application No. Mar. 23, 2015, 7 pages.

Foreign Communication From a Counterpart Application, PCT Application No. PCT/CN2012/083096, English Translation of International Search Report dated Jul. 18, 2013, 2 pages.

Foreign Communication From a Counterpart Application, PCT Application No. PCT/CN2012/083096, Written Opinion dated Jul. 18, 2013, 6 pages.

Partial English Translation and Abstract of Chinese Patent Application No. CN102158245A, Feb. 17, 2014, 3 pages.

Chu, F., et al., "Internal Coupled-Fed Dual-Loop Antenna Integrated With a USB Connector for WWAN/LTE Mobile Handset," IEEE Transactions on Antennas and Propagation, vol. 59, No. 11, Nov. 2011, pp. 4215-4221.

Hongmin, G., et al., "Design and Improvement of Printed IFA for Bluetooth System," 2011 International Conference of Soft Computing and Pattern Recognition (SoCPaR), pp. 212-216.

Partial English Translation and Abstract of Chinese Patent Application No. CN102055065A, Sep. 17, 2014, 4 pages.

Foreign Communication From a Counterpart Application, Chinese Application No. 201280003788.0, Chinese Office Action dated Jul. 23, 2014, 6 pages.

Partial English Translation and Abstract of Japanese Patent Application No. JPA2003347815, Sep. 23, 2015, 11 pages.

Partial English Translation and Abstract of Japanese Patent Application No. JPA2012178810, Sep. 23, 2015, 24 pages.

Foreign Communication From a Counterpart Application, Japanese Application No. 2014-541519, Japanese Office Action dated Aug. 4, 2015, 6 pages.

Foreign Communication From a Counterpart Application, Japanese Application No. 2014-541519, English Translation of Japanese Office Action dated Aug. 4, 2015, 7 pages.

* cited by examiner

MULTIMODE BROADBAND ANTENNA MODULE AND WIRELESS TERMINAL

CROSS-REFERENCE TO RELATED APPLICATION

This application is a continuation of International Application No. PCT/CN2012/083096, filed on Oct. 17, 2012, which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to the field of radio communications, and in particular, to a multimode broadband antenna module and a wireless terminal.

BACKGROUND

An antenna is an apparatus used to transmit or receive an electromagnetic wave signal in a radio equipment. In recent years, design and performance of an antenna of a mobile terminal used for wireless communications increasingly affect a development direction of mobile communications, and especially, greatly affect a wireless terminal such as a mobile phone, a personal digital assistant, or a Moving Picture Expert Group 3 or 4 (MP3/MP4) player. In the design of an antenna, a bandwidth characteristic significantly affects a radiation characteristic. Signal propagation and energy radiation are implemented, based on resonance of frequencies, by an antenna. If one antenna can be resonant at multiple frequencies, the antenna can work at the multiple frequencies. In another aspect, if an antenna has multiple resonance frequencies, a designer and a user may adjust a frequency and a bandwidth as required. If the antenna can work at multiple frequencies, the antenna is called a multimode broadband antenna.

During the implementation of the present invention, the inventor finds that an existing antenna that is most commonly used is a planar inverted F antenna (PIFA) antenna, and a working bandwidth of the PIFA antenna is proportional to a height of the PIFA antenna. If the working bandwidth of the PIFA antenna needs to be broadened to make the PIFA antenna become a multimode broadband antenna, the height of the PIFA antenna needs to be increased, which inevitably affects a thickness of a wireless terminal such as a mobile phone. As a result, a requirement for a thin structure of a wireless terminal such as a mobile phone cannot be met.

SUMMARY

A technical problem to be solved in the present invention is to provide a multimode broadband antenna module and a wireless terminal, so that the multimode broadband antenna module may not only have a working bandwidth of a large range but also have a small size.

In a first aspect, the present invention provides a multimode broadband antenna module, including a printed circuit board, a first radiator, and a second radiator, where the first radiator includes a connection portion, a low frequency portion, and a high frequency portion, where the low frequency portion of the first radiator is connected to the high frequency portion of the first radiator, and one end of the connection portion of the first radiator is connected to a joint between the low frequency portion and the high frequency portion of the first radiator, and the other end is electrically connected to a signal feeding end of the printed circuit board; the second radiator includes a grounding portion, a low frequency portion, and a high frequency portion, where the low frequency portion of the second radiator is connected to the high frequency portion of the second radiator, and one end of the grounding portion of the second radiator is connected to a joint between a low frequency signal and a high frequency signal of the second radiator, and the other end is electrically connected to a first grounding end of the printed circuit board; and a first predetermined distance exists between the low frequency portion of the first radiator and the low frequency portion of the second radiator, and a second predetermined distance exists between the high frequency portion of the first radiator and the high frequency portion of the second radiator, so as to form a coupling capacitance effect between the first radiator and the second radiator.

In a first possible implementation manner of the first aspect, the grounding portion of the second radiator is electrically connected to the first grounding end of the printed circuit board through an inductor.

In a second possible implementation manner of the first aspect, the connection portion of the first radiator has a planar plate structure or a stripe structure; and the grounding portion of the second radiator has a planar plate structure or a stripe structure.

In a third possible implementation manner of the first aspect, the low frequency portion of the first radiator has a stripe structure having at least one bend, the high frequency portion of the first radiator has a planar plate structure, and an electrical length of the low frequency portion of the first radiator is larger than an electrical length of the high frequency portion of the first radiator.

In a fourth possible implementation manner of the first aspect, the low frequency portion of the first radiator has a planar plate structure, the high frequency portion of the first radiator has a stripe structure having at least one bend, and an electrical length of the low frequency portion of the first radiator is larger than an electrical length of the high frequency portion of the first radiator.

In a fifth possible implementation manner of the first aspect, the low frequency portion of the second radiator and the high frequency portion of the second radiator each has a plate structure or a stripe structure, where the plate structure or the stripe structure has at least one bend; the low frequency portion of the second radiator is around the low frequency portion of the first radiator; the high frequency portion of the second radiator is around the high frequency portion of the first radiator; and an electrical length of the low frequency portion of the second radiator is larger than an electrical length of the high frequency portion of the second radiator.

In a sixth possible implementation manner of the first aspect, the low frequency portion and the high frequency portion of the first radiator are symmetrically distributed at two sides of the joint between the two, and the low frequency portion and the high frequency portion of the first radiator form a planar T-shaped plate structure or a straight stripe structure together.

In a seventh possible implementation manner of the first aspect, the low frequency portion and the high frequency portion of the second radiator are symmetrically distributed at two sides of the joint between the two, and the low frequency portion and the high frequency portion of the second radiator each has a stripe structure or a plate structure, where the stripe structure or the plate structure extends for a distance from the joint between the two and is bent towards a direction of the first radiator; and an opening formed by a bend of the low frequency portion of the second radiator is opposite to an opening formed by a bend of the high frequency portion of the second radiator.

In an eighth possible implementation manner of the first aspect, at least one part of the low frequency portion and the high frequency portion of the second radiator is located in the same plane with the first radiator.

In a ninth possible implementation manner of the first aspect, an angle of 90 degrees exists between the part of the low frequency portion of the second radiator that is located in the same plane with the first radiator and another part of the low frequency portion of the second radiator.

In a tenth possible implementation manner of the first aspect, the multimode broadband antenna module further includes: a third radiator, where the third radiator has a stripe structure having at least one bend or a straight stripe structure, and one end of the third radiator is connected to a second grounding end of the printed circuit board.

In the technical solution in the embodiment in the first aspect of the present invention, a multimode broadband antenna module is provided, where the multimode broadband antenna module includes a printed circuit board, a first radiator, and a second radiator. A working principle of the multimode broadband antenna module is that a coupling capacitance effect is formed between the first radiator and the second radiator, so as to motivate a high-order mode, thereby broadening a working frequency of the multimode broadband antenna module; and furthermore, a thickness of the multimode broadband antenna module is relatively small, so that a requirement for a thin structure of a wireless terminal such as a mobile phone is met.

In a second aspect, the present invention provides a wireless terminal, including a multimode broadband antenna module and a case body, where the multimode broadband antenna module is disposed in the case body, and the multimode broadband antenna module includes a printed circuit board, a first radiator, and a second radiator, where the first radiator includes a connection portion, a low frequency portion, and a high frequency portion, where the low frequency portion of the first radiator is connected to the high frequency portion of the first radiator, and one end of the connection portion of the first radiator is connected to a joint between a low frequency signal and a high frequency signal of the first radiator, and the other end is electrically connected to a signal feeding end of the printed circuit board; the second radiator includes a grounding portion, a low frequency portion, and a high frequency portion, where the low frequency portion of the second radiator is connected to the high frequency portion of the second radiator, and one end of the grounding portion of the second radiator is connected to a joint between a low frequency signal and a high frequency signal of the second radiator, and the other end is electrically connected to a first grounding end of the printed circuit board; and a first predetermined distance exists between the low frequency portion of the first radiator and the low frequency portion of the second radiator, and a second predetermined distance exists between the high frequency portion of the first radiator and the high frequency portion of the second radiator, so as to form a coupling capacitance effect between the first radiator and the second radiator.

In a first possible implementation manner of the second aspect, the grounding portion of the second radiator is electrically connected to the first grounding end of the printed circuit board through an inductor.

In a second possible implementation manner of the second aspect, the connection portion of the first radiator has a planar plate structure or a stripe structure; and the grounding portion of the second radiator has a planar plate structure or a stripe structure.

In a third possible implementation manner of the second aspect, the low frequency portion of the first radiator has a stripe structure having at least one bend, the high frequency portion of the first radiator has a planar plate structure, and an electrical length of the low frequency portion of the first radiator is larger than an electrical length of the high frequency portion of the first radiator.

In a fourth possible implementation manner of the second aspect, the low frequency portion of the first radiator has a planar plate structure, the high frequency portion of the first radiator has a stripe structure having at least one bend, and an electrical length of the low frequency portion of the first radiator is larger than an electrical length of the high frequency portion of the first radiator.

In a fifth possible implementation manner of the second aspect, the low frequency portion of the second radiator and the high frequency portion of the second radiator each has a plate structure or a stripe structure, where the plate structure or the stripe structure has at least one bend; the low frequency portion of the second radiator is around the low frequency portion of the first radiator; the high frequency portion of the second radiator is around the high frequency portion of the first radiator; and an electrical length of the low frequency portion of the second radiator is larger than an electrical length of the high frequency portion of the second radiator.

In a sixth possible implementation manner of the second aspect, the low frequency portion and the high frequency portion of the first radiator are symmetrically distributed at two sides of the joint between the two, and the low frequency portion and the high frequency portion of the first radiator form a planar T-shaped plate structure or a straight stripe structure together.

In a seventh possible implementation manner of the second aspect, the low frequency portion and the high frequency portion of the second radiator are symmetrically distributed at two sides of the joint between the two, and the low frequency portion and the high frequency portion of the second radiator each has a stripe structure or a plate structure, where the stripe structure or the plate structure extends for a distance from the joint between the two and is bent towards a direction of the first radiator; and an opening formed by a bend of the low frequency portion of the second radiator is opposite to an opening formed by a bend of the high frequency portion of the second radiator.

In an eighth possible implementation manner of the second aspect, at least one part of the low frequency portion and the high frequency portion of the second radiator is located in the same plane with the first radiator.

In a ninth possible implementation manner of the second aspect, an angle of 90 degrees exists between the part of the low frequency portion of the second radiator that is located in the same plane with the first radiator and another part of the low frequency portion of the second radiator.

In a tenth possible implementation manner of the second aspect, the multimode broadband antenna module further includes a third radiator, where the third radiator has a bent stripe structure or a straight stripe structure, and one end of the third radiator is connected to a second grounding end of the printed circuit board.

In the technical solution in the embodiment in the second aspect of the present invention, a wireless terminal is provided, where a multimode broadband antenna module is disposed in a case body of the wireless terminal, and the multimode broadband antenna module includes a printed circuit board, a first radiator, and a second radiator. A working principle of the multimode broadband antenna module is that a coupling capacitance effect is formed between the first radiator and the second radiator, so as to motivate a high-order mode, thereby broadening a working frequency of the multimode broadband antenna module; and furthermore, a thickness of the multimode broadband antenna module is relatively small, so that a requirement for a thin structure of a wireless terminal such as a mobile phone is met.

BRIEF DESCRIPTION OF THE DRAWINGS

To describe the technical solutions in the embodiments of the present invention more clearly, the following briefly introduces the accompanying drawings required for describing the embodiments. The accompanying drawings in the following description merely show some of the embodiments of the present invention, and a person of ordinary skill in the art may also obtain other drawings according to these accompanying drawings without creative efforts.

Figure 1:
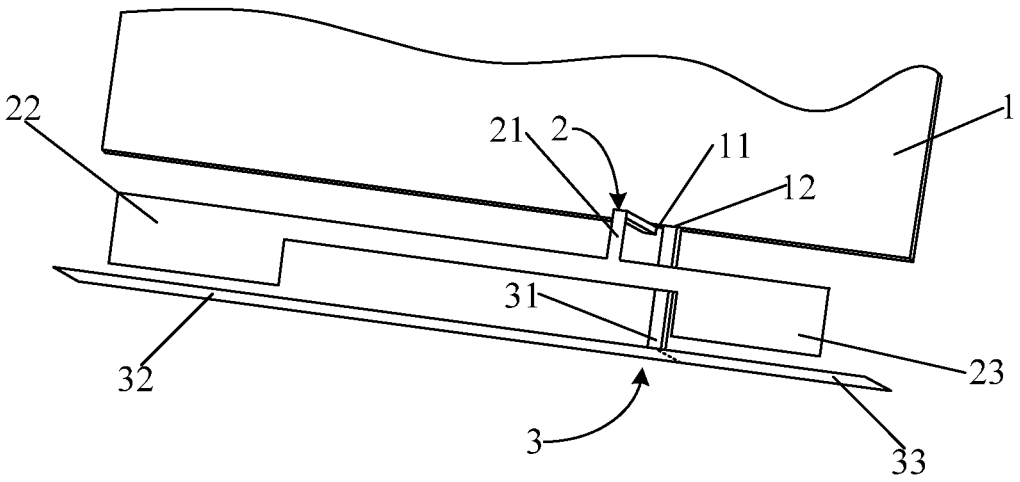
FIG. 1 is a first schematic structural diagram of a multimode broadband antenna module according to an embodiment of the present invention.

Reference numerals are described as follows:

1: Printed circuit board; 11: Signal feeding end; 12: First grounding end;
13: Second grounding end; 2: First radiator; 21: Connection portion;
22: Low frequency portion of the first radiator;
23: High frequency portion of the first radiator; 3: Second radiator;
31: Grounding portion 32: Low frequency portion of the second radiator;
33: High frequency portion of the second radiator;
4: Inductor; 5: Third radiator.

DETAILED DESCRIPTION

The following clearly describes the technical solutions in the embodiments of the present invention with reference to the accompanying drawings in the embodiments of the present invention. The embodiments to be described are merely a part rather than all of the embodiments of the present invention. All other embodiments obtained by a person of ordinary skill in the art based on the embodiments of the present invention without creative efforts shall fall within the protection scope of the present invention.

Embodiment 1

An embodiment of the present invention provides a multimode broadband antenna module, where the multimode broadband antenna module includes a printed circuit board 1, a first radiator 2, and a second radiator 3, where the first radiator 2 includes a connection portion 21, a low frequency portion 22, and a high frequency portion 23, where the low frequency portion 22 of the first radiator is connected to the high frequency portion 23 of the first radiator, and one end of the connection portion 21 of the first radiator is connected to a joint between the low frequency portion 22 and the high frequency portion 23 of the first radiator, and the other end is electrically connected to a signal feeding end 11 of the printed circuit board 1; and the second radiator 3 includes a grounding portion 31, a low frequency portion 32, and a high frequency portion 33, where the low frequency portion 32 of the second radiator is connected to the high frequency portion 33 of the second radiator, and one end of the grounding portion 31 of the second radiator is connected to a joint between the low frequency portion 32 and the high frequency portion 33 of the second radiator, and the other end is electrically connected to a first grounding end 12 of the printed circuit board 1.

As shown in FIG. 1, the three: the first radiator 2, the second radiator 3, and the printed circuit board 1 form the multimode broadband antenna module together. A communication signal of a wireless terminal is transmitted and received through the multimode broadband antenna module.

When the wireless terminal transmits a signal, the communication signal is processed by a communication module that is disposed on the printed circuit board 1 and formed by a radio frequency circuit and a baseband circuit, and is converted into a high frequency current, and the high frequency current enters the antenna module through the signal feeding end 11 on the printed circuit board 1, and then is radiated in the form of an electromagnetic wave.

When the wireless terminal receives a signal, an electromagnetic wave signal from an outer space of the wireless terminal is received by the multimode broadband antenna module and is converted into a high frequency current, and enters, through the signal feeding end 11 of the printed circuit board 1, a communication module that is disposed on the printed circuit board 1. The communication module is mainly formed by a radio frequency circuit and a baseband circuit, so that communication can be normally performed.

It should be noted that, a first predetermined distance exists between the low frequency portion 22 of the first radiator and the low frequency portion 32 of the second radiator, and a second predetermined distance exists between the high frequency portion 23 of the first radiator and the high frequency portion 33 of the second radiator, so as to form a coupling capacitance effect between the first radiator and the second radiator, where the first predetermined distance and the second predetermined distance both need to be designed and adjusted according to an actual situation, and the two may be the same or may be different.

In the prior art, an antenna module generally includes only a printed circuit board 1 and a first radiator 2. When the antenna module includes only the printed circuit board 1 and the first radiator 2, in this case, a working frequency band of the antenna module is decided by electrical lengths of a high frequency portion 23, a low frequency portion 22, and a connection portion 21 of the first radiator of the antenna module. Specifically, a sum of the electrical length of the high frequency portion 23 and the electrical length of the connection portion 21 of the antenna module is a quarter of a high frequency resonance wavelength of the antenna module. Similarly, a sum of the electrical length of the low frequency portion 22 and the electrical length of the connection portion 21 of the antenna module is a quarter of a low frequency resonance wavelength of the antenna module. In this case, the antenna module can only work around a resonance frequency corresponding to the high frequency resonance wavelength and a resonance frequency corresponding to the low frequency resonance wavelength. Obviously, in this case, a working bandwidth of the multimode broadband antenna module is relatively small.

Figure 2:
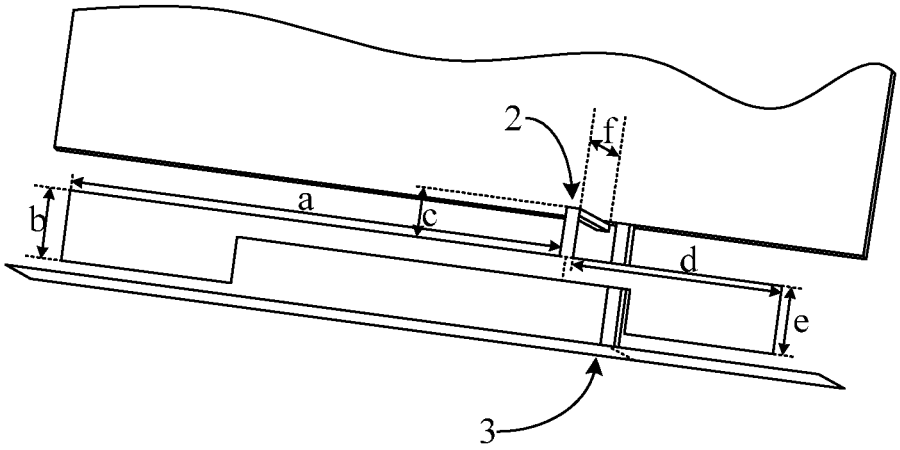
FIG. 2 is a second schematic structural diagram of the multimode broadband antenna module according to an embodiment of the present invention.

Specifically, as shown in FIG. 2, the electrical length of the high frequency portion 23 of the first radiator is a+b, and the electrical length of the connection portion is f+c, so that the high frequency resonance wavelength of the first radiator 2 is 4*[(a+b)+(f+c)]. Similarly, the electrical length of the low frequency portion 22 of the first radiator is d+e, so that the low frequency resonance wavelength of the first radiator 2 is 4*[(d+e)+(f+c)].

In addition to the printed circuit board 1 and the first radiator 2, the multimode broadband antenna module in the embodiment of the present invention further includes the second radiator 3, and the low frequency portion 22 of the first radiator is close to the low frequency portion 32 of the second radiator, and the high frequency portion 23 of the first radiator is close to the high frequency portion 33 of the second radiator. Because the low frequency portion 32 of the second radiator is close to the low frequency portion 22 of the first radiator, when a low frequency signal exists on the low frequency portion 22 of the first radiator, the low frequency portion 22 of the first radiator and the low frequency portion 32 of the second radiator form a coupling capacitance effect, so as to motivate a high-order mode, thereby broadening a working frequency band of the multimode broadband antenna module and enlarging a working frequency range.

Similarly, because the high frequency portion 33 of the second radiator is close to the high frequency portion 23 of the first radiator, when a high frequency signal exists on the high frequency portion 23 of the first radiator, the high frequency portion 23 of the first radiator and the high frequency portion 33 of the second radiator form a coupling capacitance effect, so as to motivate a high-order mode, thereby broadening the working frequency band of the multimode broadband antenna module and enlarging the working frequency range.

It should be noted that, because a working principle of the multimode broadband antenna module is that a working bandwidth of the antenna module is broadened based on a coupling capacitance effect between the first radiator 2 and the second radiator 3, a thickness of the multimode broadband antenna module can be designed and adjusted according to specific architecture and a thickness requirement of the wireless terminal; however, relevant technical personnel need to strictly adjust a distance between parts of the first radiator 2 and the second radiator 3, so as to enable the multimode broadband antenna module to work at a working frequency that meets a multimode condition.

Generally, when the wireless terminal has a strict requirement for the thickness of the multimode broadband antenna module, under the premise of meeting a radiation index of the multimode broadband antenna module, an overall thickness of the multimode broadband antenna module can be controlled to be about 4 to 5 millimeters, so that a thickness of the wireless terminal disposed with the multimode broadband antenna module can be reduced, and finally, the thickness of the wireless terminal is less than 1 centimeter, which conforms to a tendency that the wireless terminal becomes light and thin.

Further, the working frequency band of the multimode broadband antenna module can be adjusted by only adjusting lengths of the first radiator 2 and the second radiator 3 or a distance between the first radiator 2 and the second radiator 3, so that a thickness of the first radiator 2 or a thickness of the second radiator 3 of the multimode broadband antenna module can be randomly set, and the thickness of the first radiator 2 or the thickness of the second radiator 3 can be reduced as much as possible, so as to reduce material usage of the first radiator 2 or the second radiator 3 in a manufacturing process. Similarly, a width of the first radiator 2 and a width of the second radiator 3 can also be randomly set to further reduce the material usage of the first radiator 2 or the second radiator 3.

When a user uses a wireless terminal such as a mobile phone to make a call, because the brain of the user is close to an antenna module of the wireless terminal, transmission and reception performance of the wireless terminal is reduced, so that transmission and reception performance for radiation of the entire wireless terminal is reduced. In a process of researching and developing a wireless terminal, technical personnel related in the research and development quantitatively measure an impact of a human brain on transmission and reception performance of the wireless terminal, and optimally design the wireless terminal, so as to reduce the impact of the human brain on the transmission and reception performance of the wireless terminal, that is, reduce electromagnetic coupling between a human body and an antenna module.

In addition, when a user uses a wireless terminal such as a mobile phone, the user always changes a hand for holding the wireless terminal, and an impact of the left hand on transmission and reception performance of the wireless terminal when the user uses the left hand to hold the wireless terminal may be different from an impact of the right hand on the transmission and reception performance of the wireless terminal when the user uses the right hand to hold the wireless terminal. When the transmission and reception performance of the wireless terminal is greatly affected, a communication capability of the wireless terminal may be reduced, and user experience of the user for the wireless terminal is reduced.

In the embodiment of the present invention, the signal feeding end may be set at a middle position of an edge of the printed circuit board, so that signal receiving and sending capabilities of the wireless terminal are not greatly affected no matter whether the user uses the left hand or the right hand to hold the wireless terminal, and the user experience of the user is better, that is, the wireless terminal has a better head-hand simulation effect.

Generally, a clearance area occupied by the multimode broadband antenna module provided in the embodiment of the present invention is 60 millimeters long, 10 millimeters wide, and 5 millimeters high. The length of the clearance area is equal to the length of a side of the printed circuit board 1, and the multimode broadband antenna module is disposed on the side of the printed circuit board 1, and the length of the other side of the printed circuit board 1 is about 100 millimeters.

In the technical solution in the embodiment of the present invention, a multimode broadband antenna module is provided, where the multimode broadband antenna module includes a printed circuit board, a first radiator, and a second radiator. A working principle of the multimode broadband antenna module is that a coupling capacitance effect is formed between the first radiator and the second radiator, so as to motivate a high-order mode, thereby broadening a working frequency of the multimode broadband antenna module; and furthermore, a thickness of the multimode broadband antenna module is relatively small, so that a requirement for a thin structure of a wireless terminal such as a mobile phone is met.

Embodiment 2

An embodiment of the present invention provides a multimode broadband antenna module, as shown in FIG. 1.

The multimode broadband antenna module includes a printed circuit board 1, a first radiator 2, and a second radiator 3, where the first radiator 2 includes a connection portion 21, a low frequency portion 22, and a high frequency portion 23, where the low frequency portion 22 of the first radiator is connected to the high frequency portion 23 of the first radiator, and one end of the connection portion 21 of the first radiator is connected to a joint between the low frequency portion 22 and the high frequency portion 23 of the first radiator, and the other end is electrically connected to a signal feeding end 11 of the printed circuit board 1; and the second radiator 3 includes a grounding portion 31, a low frequency portion 32, and a high frequency portion 33, where the low frequency portion 32 of the second radiator is connected to the high frequency portion 33 of the second radiator, and one end of the grounding portion 31 of the second radiator is connected to a joint between the low frequency portion 32 and the high frequency portion 33 of the second radiator, and the other end is electrically connected to a first grounding end 12 of the printed circuit board 1.

As shown in FIG. 1, the three: the first radiator 2, the second radiator 3, and the printed circuit board 1 form the multimode broadband antenna module together. A communication signal of a wireless terminal is transmitted and received through the multimode broadband antenna module.

When the wireless terminal transmits a signal, the communication signal is processed by a communication module that is disposed on the printed circuit board 1 and formed by a radio frequency circuit and a baseband circuit, and is converted into a high frequency current, and the high frequency current enters the antenna module through the signal feeding end 11 on the printed circuit board 1, and then is radiated in the form of an electromagnetic wave.

When the wireless terminal receives a signal, an electromagnetic wave signal from an outer space of the wireless terminal is received by the multimode broadband antenna module and is converted into a high frequency current, and enters, through the signal feeding end 11 of the printed circuit board 1, a communication module that is disposed on the printed circuit board 1. The communication module is mainly formed by a radio frequency circuit and a baseband circuit, so that communication can be normally performed.

It should be noted that, a first predetermined distance exists between the low frequency portion 22 of the first radiator and the low frequency portion 32 of the second radiator, and a second predetermined distance exists between the high frequency portion 23 of the first radiator and the high frequency portion 33 of the second radiator, so as to form a coupling capacitance effect between the first radiator and the second radiator, where the first predetermined distance and the second predetermined distance both need to be designed and adjusted according to an actual situation, and the two may be the same or may be different.

Because a working principle of broadening a working frequency band of the multimode broadband antenna module relies on a coupling capacitance effect between the first radiator 2 and the second radiator 3 on the basis of ensuring an electrical length of the first radiator 2, to broaden a working bandwidth of the antenna module, a thickness of the multimode broadband antenna module can be designed and adjusted according to specific architecture and a thickness requirement of the wireless terminal; however, relevant technical personnel need to strictly adjust a distance between parts of the first radiator 2 and the second radiator 3, so as to enable the multimode broadband antenna module to work at a working frequency that meets a multimode condition.

Generally, when the wireless terminal has a strict requirement for the thickness of the multimode broadband antenna module, under the premise of meeting a radiation index of the multimode broadband antenna module, an overall thickness of the multimode broadband antenna module can be controlled to be about 4 to 5 millimeters, so that a thickness of the wireless terminal disposed with the multimode broadband antenna module can be reduced, and finally, the thickness of the wireless terminal is less than 1 centimeter, which conforms to a tendency that the wireless terminal becomes light and thin.

Figure 3:
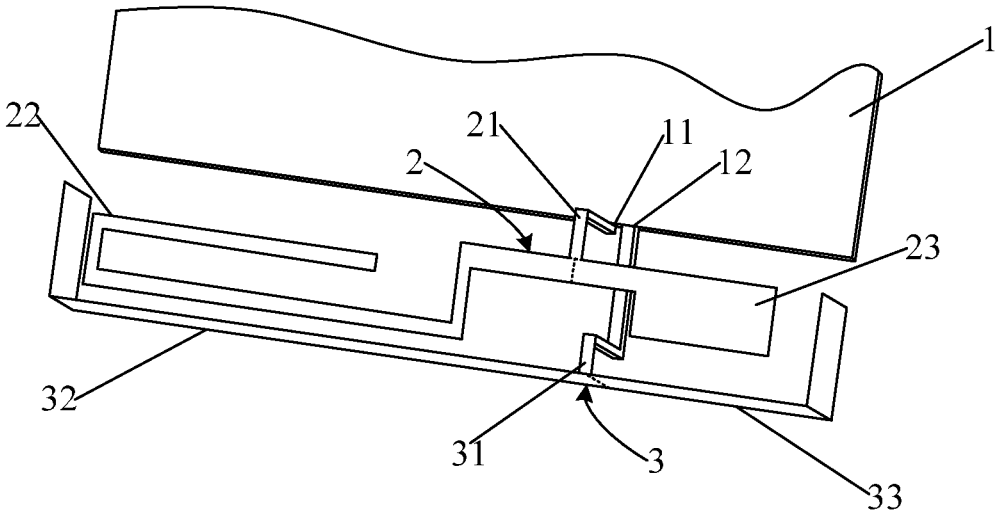
FIG. 3 is a first schematic structural diagram of a first multimode broadband antenna module according to an embodiment of the present invention.

The embodiment of the present invention further provides multiple specific implementation forms of the foregoing multimode broadband antenna module, which are as follows:

FIG. 3 shows a first specific structure of a first multimode broadband antenna module, and a specific structure of the first multimode broadband antenna module is as follows:

The low frequency portion 22 of the first radiator has a stripe structure having at least one bend, the high frequency portion 23 of the first radiator has a planar plate structure, and an electrical length of the low frequency portion 22 of the first radiator is larger than an electrical length of the high frequency portion 23 of the first radiator.

The low frequency portion 32 of the second radiator and the high frequency portion 33 of the second radiator each has a plate structure having at least one bend, the low frequency portion 32 of the second radiator is around the low frequency portion 22 of the first radiator, the high frequency portion 33 of the second radiator is around the high frequency portion 23 of the first radiator, and an electrical length of the low frequency portion 32 of the second radiator is larger than an electrical length of the high frequency portion 33 of the second radiator.

When an antenna module includes only a printed circuit board 1 and a first radiator 2, in this case, a working frequency band of the antenna module is decided by electrical lengths of a high frequency portion 23, a low frequency portion 22, and a connection portion 21 of the first radiator of the antenna module. Specifically, a sum of the electrical length of the high frequency portion 23 and the electrical length of the connection portion 21 of the antenna module is a quarter of a high frequency resonance wavelength of the antenna module. Similarly, a sum of the electrical length of the low frequency portion 22 and the electrical length of the connection portion 21 of the antenna module is a quarter of a low frequency resonance wavelength of the antenna module. In this case, the antenna module can only work around a resonance frequency corresponding to the high frequency resonance wavelength and a resonance frequency corresponding to the low frequency resonance wavelength. Obviously, in this case, a working bandwidth of the multimode broadband antenna module is relatively small.

Figure 4:
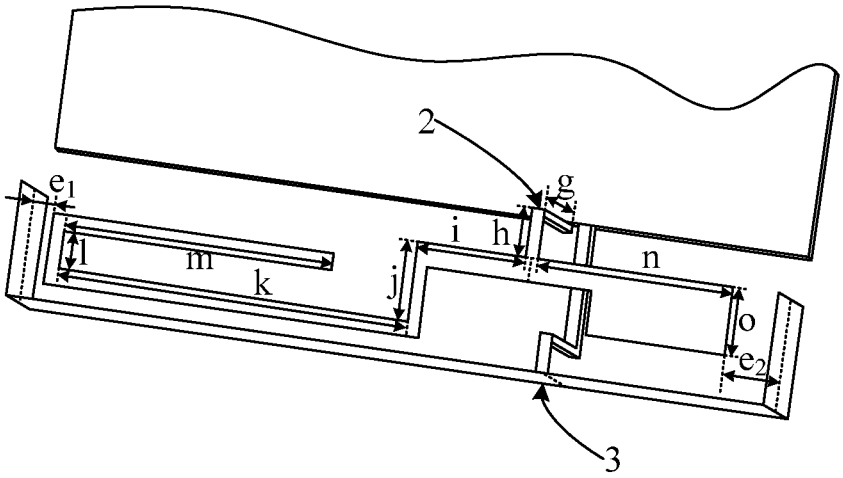
FIG. 4 is a second schematic structural diagram of the first multimode broadband antenna module according to an embodiment of the present invention.

Specifically, as shown in FIG. 4, the electrical length of the high frequency portion 23 of the first radiator is n+o, and the electrical length of the connection portion 21 is g+h, so that the high frequency resonance wavelength of the first radiator 2 is 4*[(n+o)+(g+h)]. Similarly, the electrical length of the low frequency portion 22 of the first radiator is i+j+k+1+m, so that the low frequency resonance wavelength of the first radiator 2 is 4*[(i+j+k+1+m)+(g+h)].

In addition to the printed circuit board 1 and the first radiator 2, the multimode broadband antenna module in the embodiment of the present invention further includes the second radiator 3, and the low frequency portion 22 of the first radiator is close to the low frequency portion 32 of the second radiator, and the high frequency portion 23 of the first radiator is close to the high frequency portion 33 of the second radiator. Because the low frequency portion 32 of the second radiator is close to the low frequency portion 22 of the first radiator, when a low frequency signal exists on the low frequency portion 22 of the first radiator, the low frequency portion 22 of the first radiator and the low frequency portion 32 of the second radiator form a coupling capacitance effect, so as to motivate a high-order mode, thereby broadening a working frequency band of the multimode broadband antenna module and enlarging a working frequency range.

Specifically, in the specific structure of the first multimode broadband antenna module, a distance between the low frequency portion 22 of the first radiator and the low frequency portion 32 of the second radiator is $e_1$, and $e_1$ is roughly 0.5 millimeter; and a distance between the high frequency portion 23 of the first radiator and the high frequency portion 33 of the second radiator is $e_2$, and $e_2$ is roughly 3 millimeters.

When a size of the terminal needs to be relatively small, multiple bends may be set at a certain part of an antenna, and a total electrical length of the antenna is kept under the premise of ensuring that the size of the antenna is relatively small, so as to further keep a resonance wavelength of the antenna.

Figure 5:
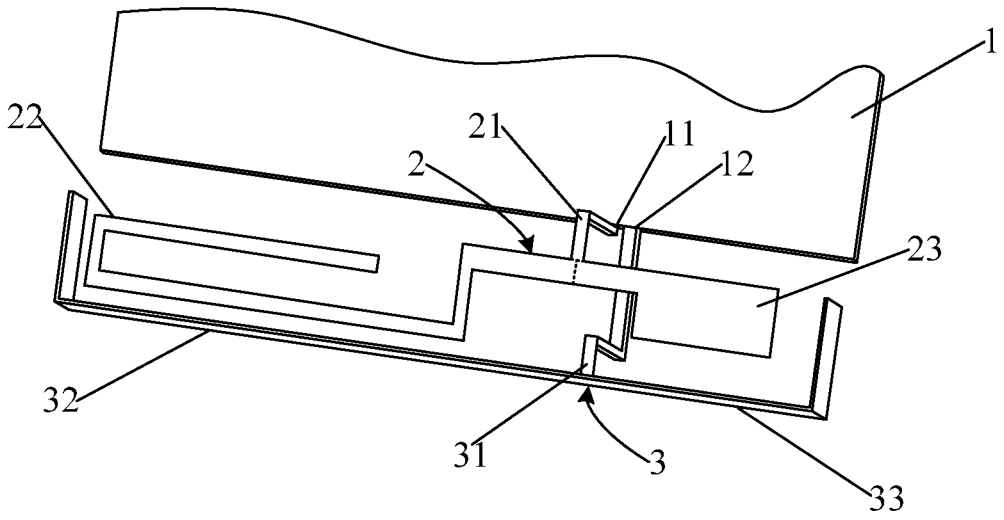
FIG. 5 is a third schematic structural diagram of the first multimode broadband antenna module according to an embodiment of the present invention.

Further, the second radiator 3 of the first multimode broadband antenna module may also have a stripe structure having at least one bend, as shown in FIG. 5.

Figure 6:
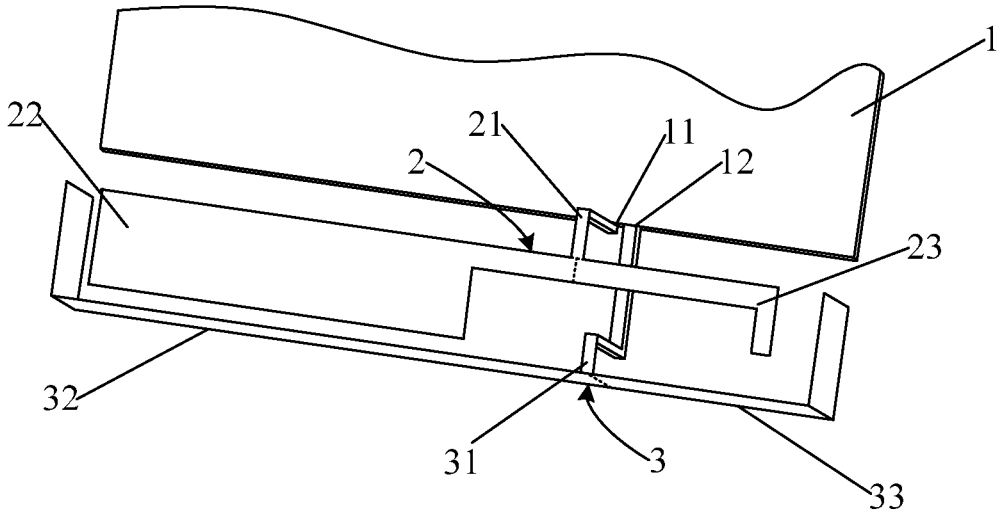
FIG. 6 is a fourth schematic structural diagram of the first multimode broadband antenna module according to an embodiment of the present invention.

Similarly, in a situation where a shape, length, and position of the second radiator 3 are not changed, structures and shapes of the low frequency portion 22 of the first radiator 2 and the high frequency portion 23 of the first radiator may be randomly set; however, a premise of the random setting is keeping a length of the low frequency portion 22 of the first radiator as two times of a length of the high frequency portion 23 of the first radiator, and ensuring that a result of the coupling capacitance effect between the first radiator 2 and the second radiator 3 is not changed. For example, the shape of the low frequency portion 22 of the first radiator is exchanged with that of the high frequency portion 23, that is, the low frequency portion 22 of the first radiator has a planar plate structure, and the high frequency portion 23 of the first radiator has a stripe structure having at least one bend, as shown in FIG. 6.

It should be noted that, in the embodiment of the present invention, to enable the working frequency band of the multimode broadband antenna module to meet a requirement of a designer, it needs to ensure that the length of the low frequency portion 22 of the first radiator of the first multimode broadband antenna module is about two times of the length of the high frequency portion 23 of the first radiator.

Figure 7:
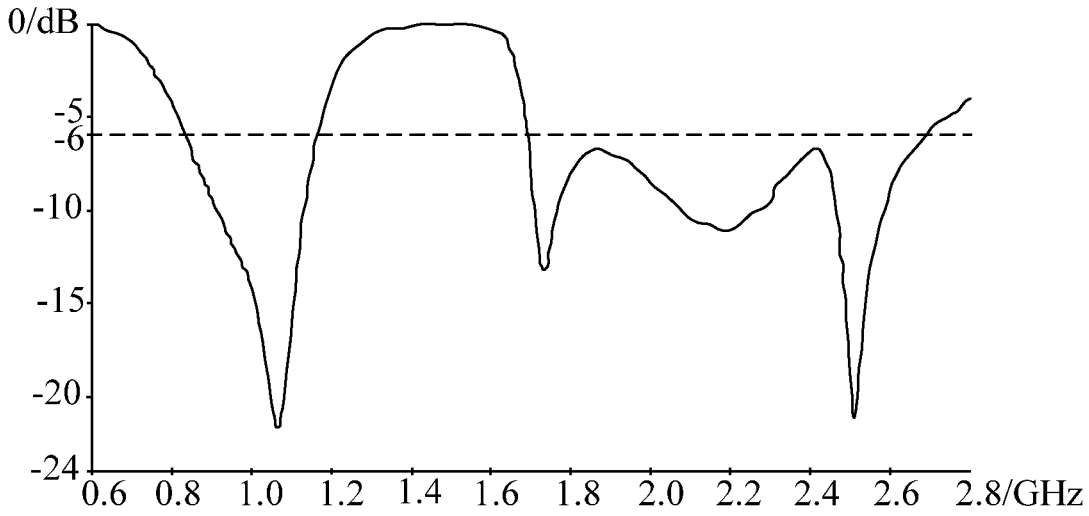
FIG. 7 is a simulation diagram of return loss of the first multimode broadband antenna module according to an embodiment of the present invention.

Further, as shown in FIG. 7, a minimum low frequency working frequency (where return loss is lower than −6 decibel (dB)) of the first multimode broadband antenna module can reach about 824 megahertz (MHz), and a low frequency working bandwidth is 824 MHz to approximately 1200 MHz. A maximum high frequency working frequency (where the return loss is lower than −6 dB) of the multimode broadband antenna module can reach above 2500 MHz, and a high frequency working bandwidth is about 1600 MHz to above 2500 MHz.

It is well known that, frequency bands commonly used in business at a present stage include eight frequency bands in total, that is, a global system for mobile communications (GSM), GSM850 (824 MHz to 894 MHz) and GSM900 (880 MHz to 960 MHz), a global positioning system (GPS) (1575 MHz), digital video broadcasting (e.g., Digital Video Broadcasting-Handheld (DVB-H)) (1670 MHz to 1675 MHz), a data communication subsystem (DCS) (1710 MHz to 1880 MHz), and a personal communications service (PCS) (1900

MHz), a universal mobile telecommunications system (UMTS) or a third generation mobile communications technology (3rd-generation or 3G) (1920 MHz to 2175 MHz), and Bluetooth or a wireless local area network (WLAN) 802.11b/g (2400 MHz to 2484 MHz). It can be seen that, the working frequency band of the multimode broadband antenna module provided in the embodiment of the present invention can completely cover the foregoing eight frequency bands, so that the multimode broadband antenna module in the embodiment of the present invention can meet a requirement of most wireless terminal services for a working frequency band.

In addition, a long term evolution (LTE) project is a currently hot working frequency band, and the research of the LTE includes some parts that are generally considered quite important, such as reducing of a waiting time, a higher user data rate, improvement of system capacity and coverage, and reducing of an operating cost. A working frequency band of the LTE is 698 MHz to 960 MHz and 1710 MHz to 2700 MHz.

It should be noted that, it can be seen from FIG. 7 that, a low frequency of the working frequency band of the multimode broadband antenna module cannot cover 698 MHz; however, FIG. 7 is a simulation diagram of return loss of the multimode broadband antenna module, because the multimode broadband antenna module is disposed in a case body of a wireless terminal such as a mobile phone, with a function of the case body, the working frequency band of the multimode broadband antenna module can be offset to a low frequency band overall, so that the low frequency can cover a working frequency band of 698 MHz of the LTE, which is specifically as follows:

It is well known that, for an electromagnetic wave, the following formula exists:

$$v = \frac{c_0}{\sqrt{\varepsilon_r}},$$

where v indicates a transmission rate of the electromagnetic wave in a certain medium, $\epsilon_r$ indicates a dielectric constant of a case body, and $c_0$ indicates a speed of light in a vacuum situation, that is, a transmission rate of the electromagnetic wave, and is a constant.

In addition, for the electromagnetic wave, the following formula further exists:

$v=\lambda_\epsilon \cdot f_\epsilon$, where $\lambda_\epsilon$ indicates a wavelength of a resonant electromagnetic wave of the multimode broadband antenna module, and $f_\epsilon$ indicates a frequency of the resonant electromagnetic wave of the multimode broadband antenna module, and according to the foregoing two formulas, the following formula exists:

$$\lambda_\varepsilon \cdot f_\varepsilon = \frac{c_0}{\sqrt{\varepsilon_r}},$$

and $\lambda_\epsilon \cdot f_\epsilon \cdot \sqrt{\epsilon_r} = c_0$ is obtained after adjustment.

Because $c_0$ is a constant, and $\lambda_\epsilon$ is the wavelength of the resonant electromagnetic wave of the multimode broadband antenna module and has a direct relationship with a size of the multimode broadband antenna module, once the size of the multimode broadband antenna module is fixed, $\lambda_\epsilon$ of the multimode broadband antenna module is also fixed. Therefore, $\lambda_\epsilon$ is also a constant.

Further, $\sqrt{\epsilon_r}$ of a case of a wireless terminal is generally larger than that of the vacuum, to enable both sides of the equal sign to be equal, $f_\epsilon$ must be reduced, that is, a resonance frequency is offset to a low frequency, that is, an overall return loss curve of the multimode broadband antenna module is offset to the left.

Therefore, the working frequency band of the multimode broadband antenna module can cover the working frequency band of the LTE.

It should be noted that, a distance between the low frequency portion 22 of the first radiator and the low frequency portion 32 of the second radiator of the first multimode broadband antenna module is about 0.5 millimeter, and a distance between the high frequency portion 23 of the first radiator and the high frequency portion 33 of the second radiator is about 2 to 3 millimeters.

Figure 8:
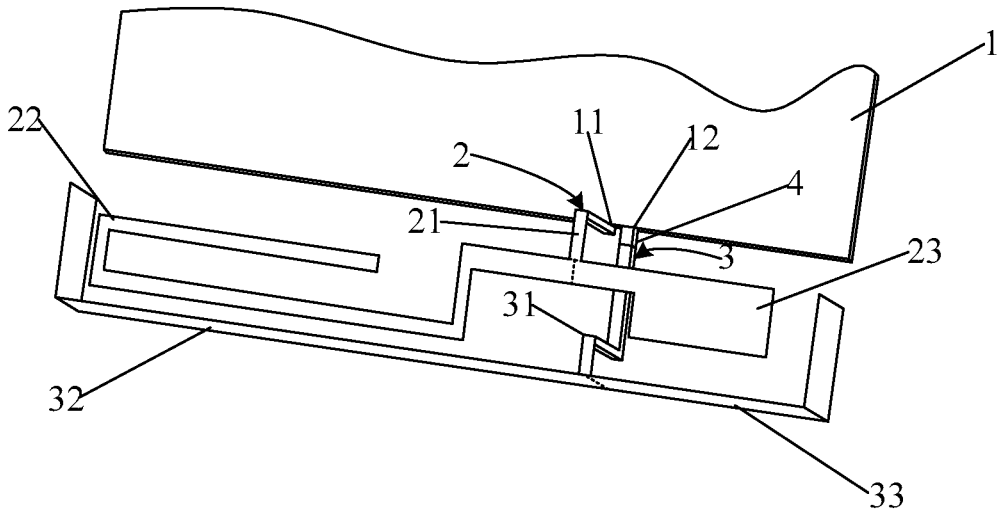
FIG. 8 is a schematic structural diagram of a second multimode broadband antenna module according to an embodiment of the present invention.

As shown in FIG. 8, based on the first multimode broadband antenna module provided in FIG. 3, the second radiator 3 of the multimode broadband antenna module may further be electrically connected to the first grounding end 12 through an inductor 4, which is a second multimode broadband antenna module.

Figure 9:
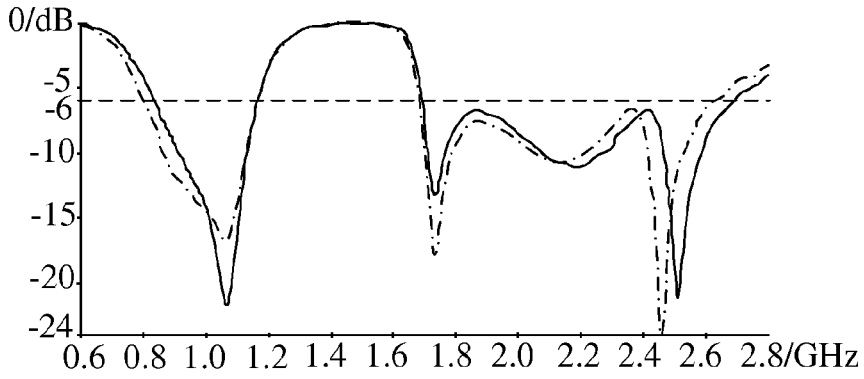
FIG. 9 is a simulation comparison diagram of return loss of the first multimode broadband antenna module and return loss of the second multimode broadband antenna module according to an embodiment of the present invention.

The inductor 4 is disposed on the second radiator 3, which can effectively increase an electrical length of the second radiator 3, and further reduces a low frequency resonance frequency and a high frequency resonance frequency of the second radiator 3. In a situation where the first multimode broadband antenna module has the same size with the second multimode broadband antenna module, as shown by the dot-dash line in FIG. 9, a minimum working frequency of the second multimode broadband antenna module disposed with the inductor 4 is lower than 800 MHz. In the same way, a maximum working frequency is also reduced. It means that when a requirement for a size of a terminal is high, in a situation where a working bandwidth requirement is met, the inductor 4 whose inductance value is appropriate may be used to further reduce an overall size of the multimode broadband antenna module. Generally, the inductor 4 may be disposed at the root of the second radiator 3, which can achieve a function of reducing the size of the multimode broadband antenna module, so that the multimode broadband antenna module can better meet a requirement of a wireless terminal that gradually becomes light and thin.

Figure 10:
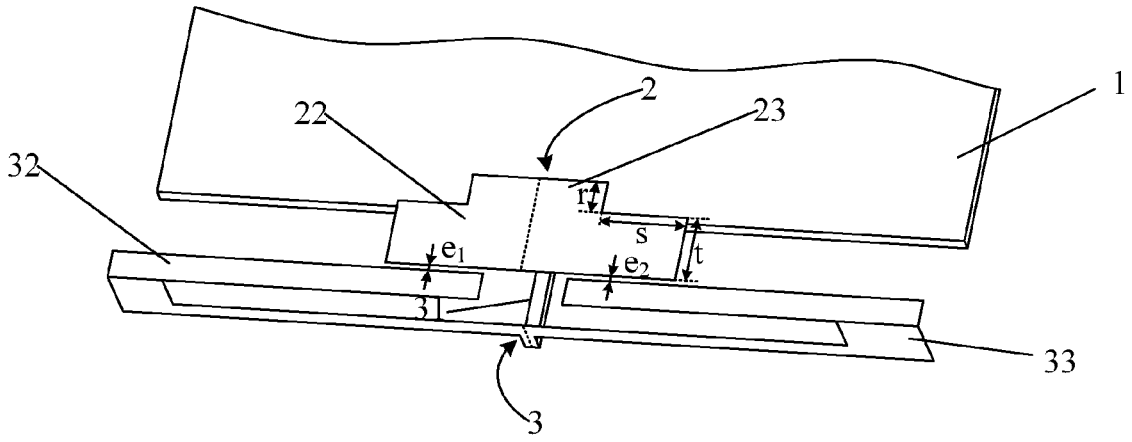
FIG. 10 is a first schematic structural diagram of a third multimode broadband antenna module according to an embodiment of the present invention.
Figure 11:
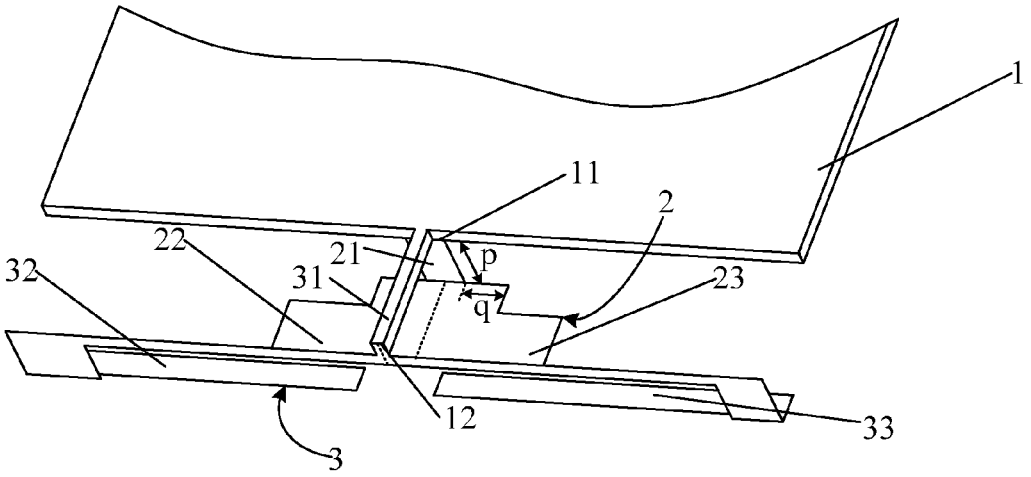
FIG. 11 is a second schematic structural diagram of the third multimode broadband antenna module according to an embodiment of the present invention.

The embodiment of the present invention further provides a third multimode broadband antenna module. As shown in FIG. 10 or FIG. 11, a specific structure of the third multimode broadband antenna module is as follows:

The first radiator has a planar plate "T"-shaped structure, and the low frequency portion 22 and the high frequency portion 23 of the first radiator have the same shape and are symmetrically distributed at two sides of the joint between the two.

Meanwhile, the low frequency portion 32 and the high frequency portion 33 of the second radiator have the same shape and are symmetrically distributed at two sides of the joint between the two, and the low frequency portion 32 and the high frequency portion 33 of the second radiator each has a plate structure that extends for a distance from the joint between the two and is bent towards a direction of the first radiator 2.

As shown in FIG. 11, an electrical length of the connection portion 21 of the first radiator 2 of the third multimode broadband antenna module is p, and as shown in FIG. 10, an electrical length of the high frequency portion 23 of the first radiator is r+s+t, so that a high frequency resonance wavelength of the first radiator is 4*[(r+s+t)+p]; and because the high frequency portion 23 and the low frequency portion 22 of the first radiator have a symmetrical structure, a low frequency resonance wavelength of the first radiator is 4*[(r+s+t)+p], that is, a working frequency band of the high frequency portion 23 and a working frequency band of the low frequency portion 22 of the first radiator coincide. In this case, a working frequency band range of the third multimode broadband antenna module is relatively small.

Therefore, a coupling capacitance effect generated due to a distance between the second radiator 3 and the first radiator 2 needs to be used to broaden a working frequency band of the third multimode broadband antenna module.

Figure 13:
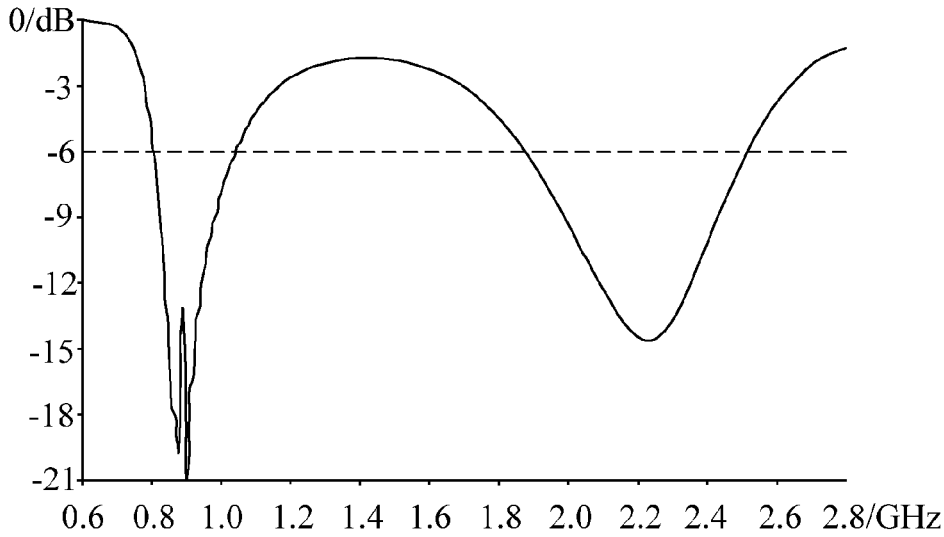
FIG. 13 is a simulation diagram of return loss of the third multimode broadband antenna module according to an embodiment of the present invention.

In this case, a distance $e_1$ between the low frequency portion 22 of the first radiator and the low frequency portion 32 of the second radiator is about 0.5 millimeter, and because the structure is a symmetrical structure, a distance $e_2$ between the high frequency portion 23 of the first radiator and the high frequency portion 33 of the second radiator is also about 0.5 millimeter. FIG. 13 shows a simulation diagram of return loss of the multimode broadband antenna module, where a low frequency working frequency band (where return loss is lower than −6 dB) of the multimode broadband antenna module is roughly 800 to approximately 1100 MHz, and a high frequency working frequency band (where the return loss is lower than −6 dB) is roughly 1900 MHz to approximately 2500 MHz.

Specifically, an opening formed by a bend of the low frequency portion 32 of the second radiator is opposite to an opening formed by a bend of the high frequency portion 33 of the second radiator. Furthermore, at least one part of the low frequency portion 32 and the high frequency portion 33 of the second radiator is roughly located in the same plane with the first radiator 2.

Further, in consideration of factors such as convenient manufacturing, easy debugging, and an aesthetic structure, an angle of roughly 90 degrees exists between the part of the low frequency portion 32 of the second radiator that is located in the same plane with the first radiator 2 and another part of the low frequency portion 32 of the second radiator.

Figure 12:
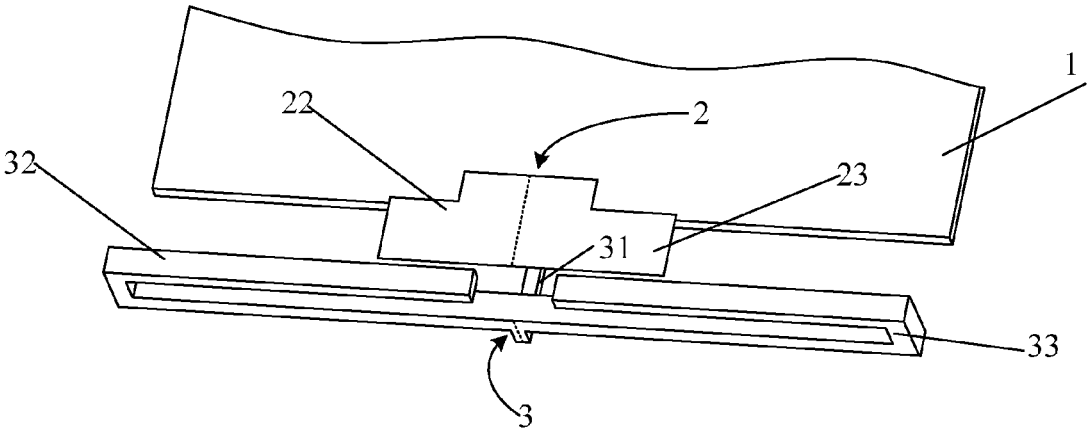
FIG. 12 is a third schematic structural diagram of the third multimode broadband antenna module according to an embodiment of the present invention.

Similarly, the low frequency portion 32 and the high frequency portion 33 of the second radiator may also have a stripe structure, as shown in FIG. 12.

Further, the embodiment of the present invention further provides a fourth multimode broadband antenna module, where the low frequency portion 22 and the high frequency portion 23 of the first radiator of the fourth multimode broadband antenna module form a straight stripe structure together, and the low frequency portion 22 and the high frequency portion 23 of the first radiator of the fourth multimode broadband antenna module have the same shape and are symmetrically distributed at two sides of the joint between the two.

Meanwhile, the low frequency portion 32 and the high frequency portion 33 of the second radiator have the same shape and are symmetrically distributed at two sides of the joint between the two, and the low frequency portion 32 and the high frequency portion 33 of the second radiator each has a plate structure that extends for a distance from the joint between the two and is bent towards a direction of the first radiator 2.

Figure 15:
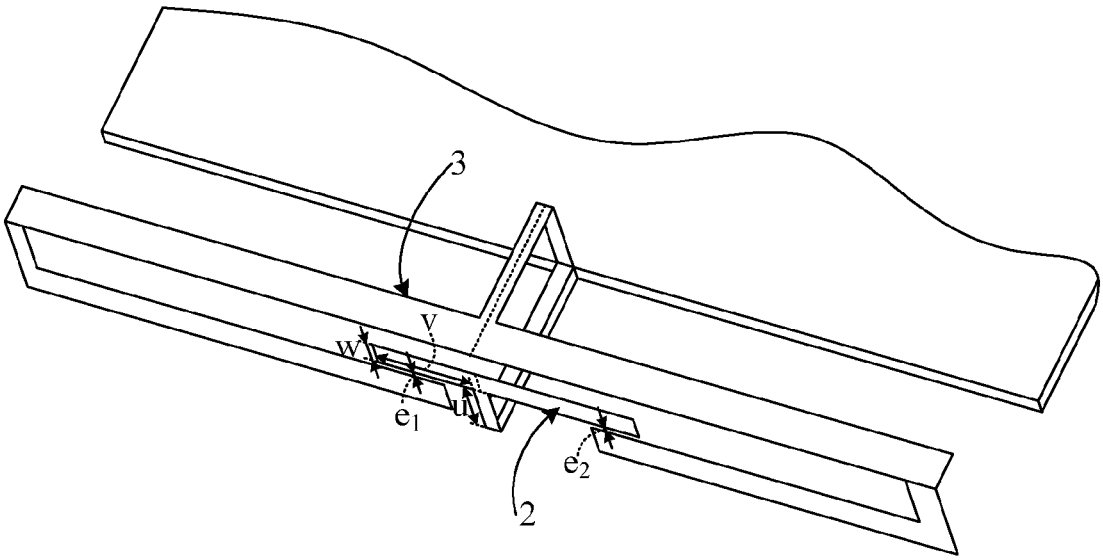
FIG. 15 is a second schematic structural diagram of the fourth multimode broadband antenna module according to an embodiment of the present invention.

As shown in FIG. 15, an electrical length of the connection portion 21 of the first radiator 2 of the fourth multimode broadband antenna module is u, and an electrical length of the high frequency portion 23 of the first radiator is v+w, so that a high frequency resonance wavelength of the first radiator is 4*[(v+w)+u]; and because the high frequency portion and the low frequency portion of the first radiator have a symmetrical structure, a low frequency resonance wavelength of the first radiator is 4*[(v+w)+u].

In the same way, a coupling capacitance effect generated due to a distance between the second radiator and the first radiator needs to be used to broaden a working frequency band of the multimode broadband antenna module.

Figure 17:
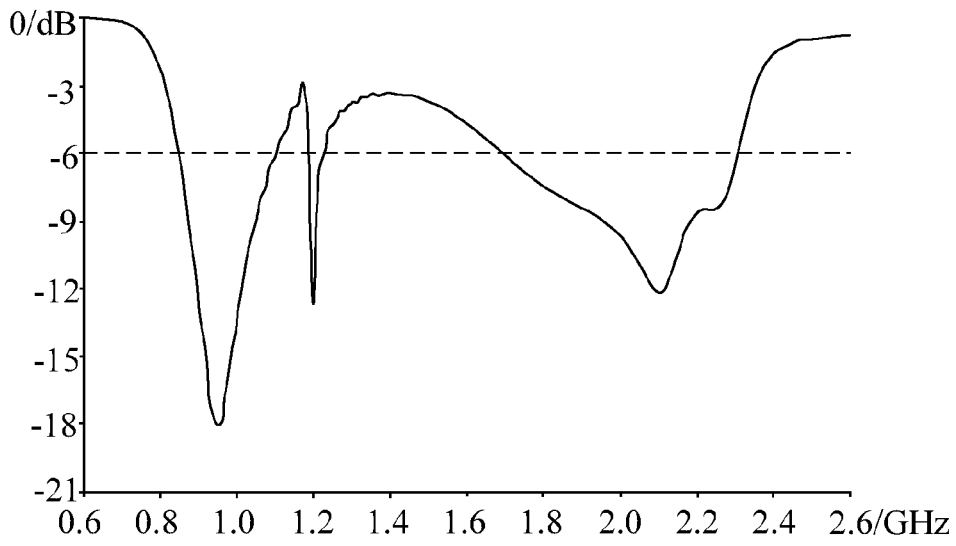
FIG. 17 is a simulation diagram of return loss of the fourth multimode broadband antenna module according to an embodiment of the present invention.

In this case, a distance $e_1$ between the low frequency portion 22 of the first radiator and the low frequency portion 32 of the second radiator is about 0.5 millimeter, and because the structure is a symmetrical structure, a distance $e_2$ between the high frequency portion 23 of the first radiator and the high frequency portion 33 of the second radiator is also about 0.5 millimeter. FIG. 17 shows a simulation diagram of return loss of the fourth multimode broadband antenna module, where a low frequency working frequency band (where return loss is lower than −6 dB) of the multimode broadband antenna module is roughly 850 MHz to about 1100 MHz, and a high frequency working frequency band (where the return loss is lower than −6 dB) is roughly 1700 MHz to 2300 MHz.

Specifically, an opening formed by a bend of the low frequency portion 32 of the second radiator is opposite to an opening formed by a bend of the high frequency portion 33 of the second radiator. Furthermore, at least one part of the low frequency portion 32 and the high frequency portion 33 of the second radiator is roughly located in the same plane with the first radiator 2.

Further, in consideration of factors such as convenient manufacturing, easy debugging, and an aesthetic structure, an angle of roughly 90 degrees exists between the part of the low frequency portion 32 of the second radiator that is located in the same plane with the first radiator 2 and another part of the low frequency portion 32 of the second radiator.

Figure 16:
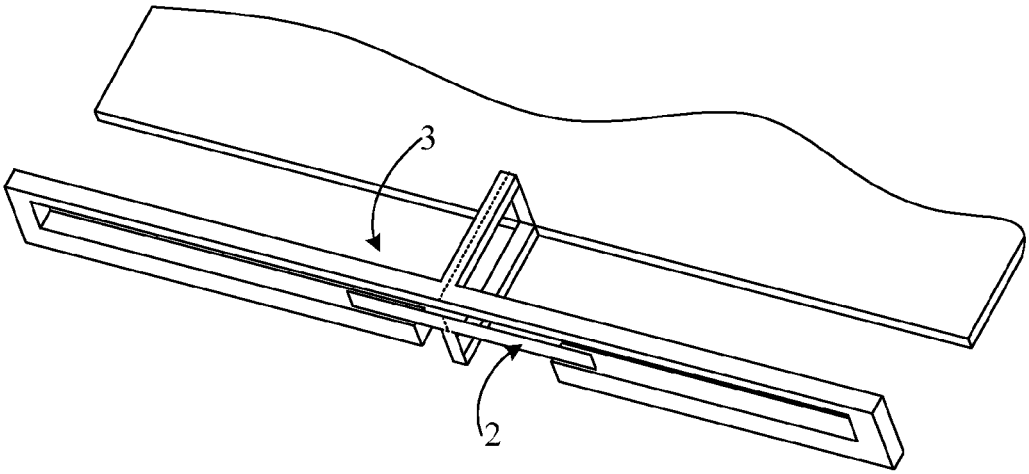
FIG. 16 is a third schematic structural diagram of the fourth multimode broadband antenna module according to an embodiment of the present invention.

Similarly, the low frequency portion 32 and the high frequency portion 33 of the second radiator may also have a stripe structure, as shown in FIG. 16.

Figure 14:
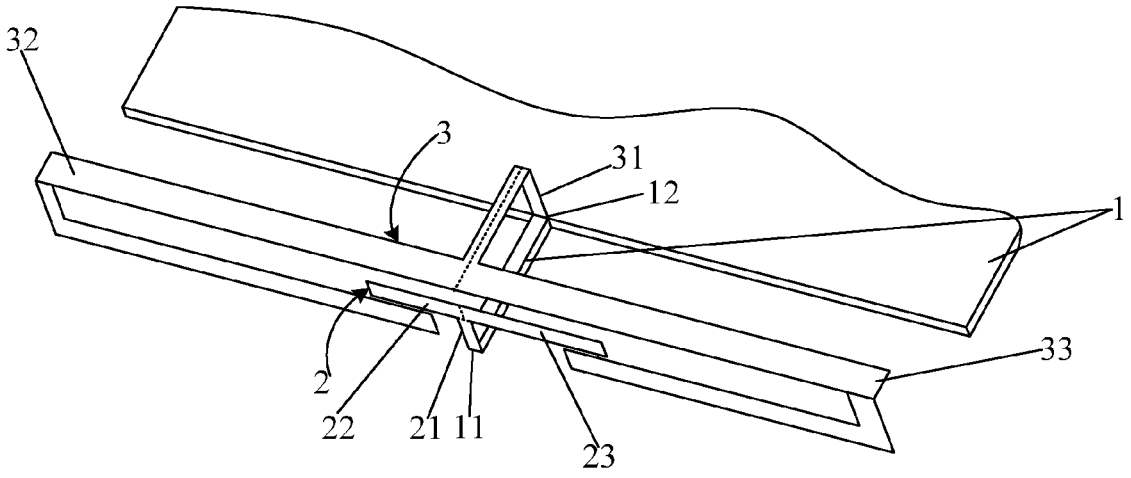
FIG. 14 is a first schematic structural diagram of a fourth multimode broadband antenna module according to an embodiment of the present invention.

It should be noted that, it can be seen from FIG. 13 or FIG. 17 that, a low frequency of the working frequency band of the third or fourth multimode broadband antenna module cannot cover 698 MHz; however, because the multimode broadband antenna module is disposed in a case body of a wireless terminal such as a mobile phone, with a function the case body, the working frequency band of the multimode broadband antenna module can be offset to a low frequency band overall, so that the low frequency can cover a working frequency band of 698 MHz of the LTE. Accordingly, the working frequency bands of the third and fourth multimode broadband antenna modules shown in FIG. 10 and FIG. 14 can cover the working frequency band of the LTE.

Figure 18:
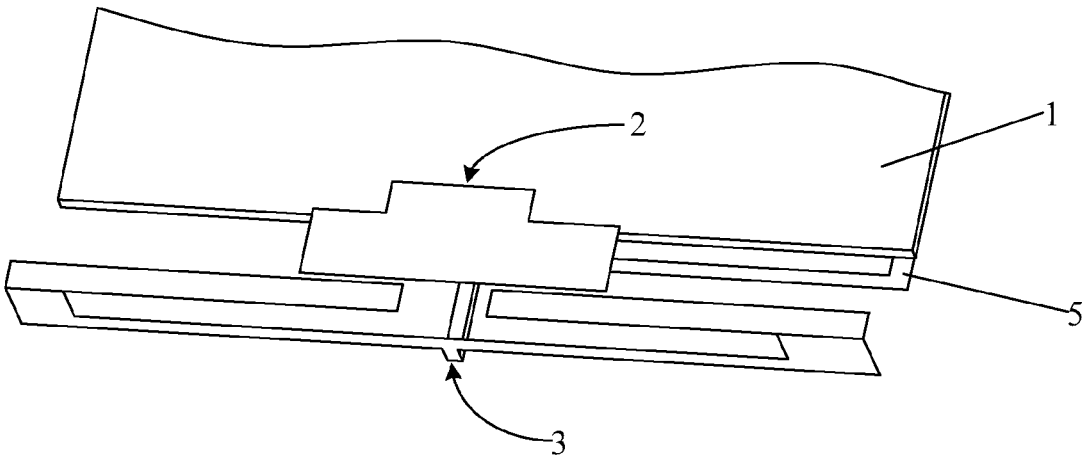
FIG. 18 is a first schematic structural diagram of a fifth multimode broadband antenna module according to an embodiment of the present invention.
Figure 19:
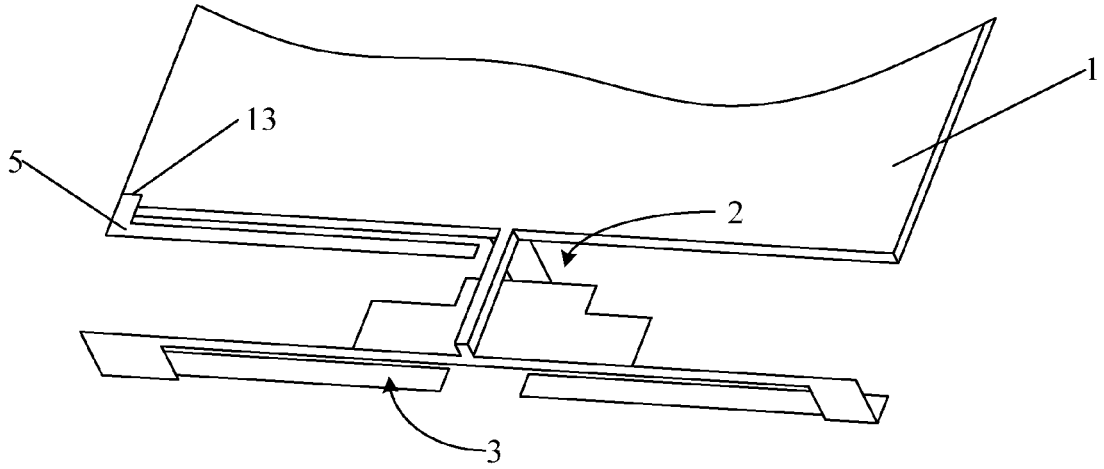
FIG. 19 is a second schematic structural diagram of the fifth multimode broadband antenna module according to an embodiment of the present invention.

As shown in FIG. 18 or FIG. 19, a third radiator 5 may further be disposed at a second grounding end 13 of the printed circuit board 1 of the multimode broadband antenna module shown in FIG. 10 or FIG. 11, which is a fifth multimode broadband antenna module. The third radiator 5 may have a stripe structure having at least one bend, and one end of the third radiator 5 is connected to the second grounding end 13 of the printed circuit board 1.

The third radiator 5 is configured to further broaden the working frequency band of the multimode broadband antenna module, and the third radiator 5 is equivalent to a monopole antenna, and a resonance frequency of the third radiator 5, that is, a working frequency of the third radiator 5, is decided by an electrical length of the third radiator 5, and generally, the electrical length of the third radiator 5 is a quarter of a working wavelength corresponding to the working frequency of the third radiator 5.

During design, the electrical length of the third radiator 5 may be an electrical length corresponding to a frequency at which the first radiator 2 and the second radiator 3 cannot work, so as to achieve a function of further broadening the working bandwidth of the multimode broadband antenna module. Because a wavelength of an electromagnetic wave is inversely proportional to a frequency, and the electrical length of the third radiator 5 is a quarter of the wavelength corresponding to the working frequency of the third radiator 5, the smaller the working frequency of the third radiator 5 is, the larger the electrical length of the third radiator 5 is, or the larger the working frequency of the third radiator 5 is, the smaller the electrical length of the third radiator 5 is. In consideration of miniaturization of a size of a wireless terminal, generally, only the third radiator 5 is configured to broaden a bandwidth of a high frequency band, and in this case, the electrical length of the third radiator 5 is relatively small. For example, the resonance frequency of the third radiator 5 is set to about 2 gigahertz (GHz), and in this case, a length of the third radiator 5 is about 37.5 millimeters.

By adopting a structure having multiple bends, the third radiator 5 can have a relatively large length in a relatively small setting area, so as to meet a requirement for the length of the third radiator 5.

Figure 20:
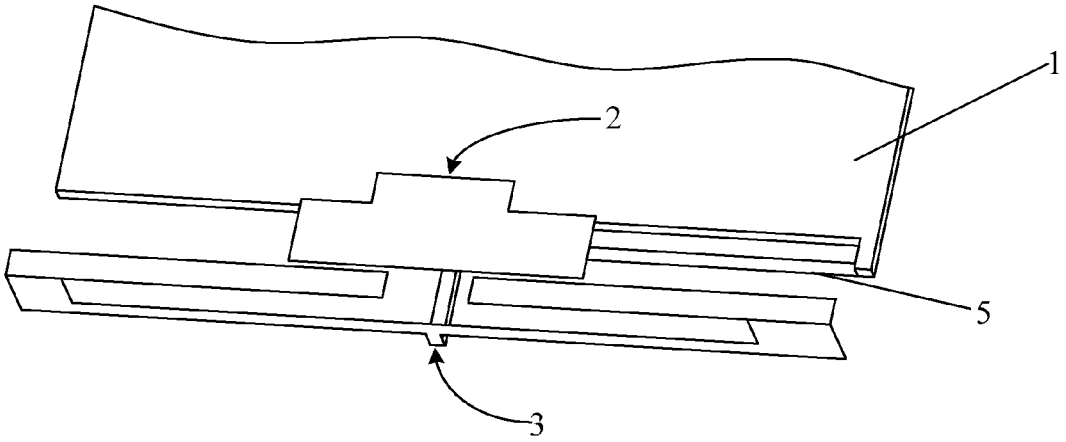
FIG. 20 is a third schematic structural diagram of the fifth multimode broadband antenna module according to an embodiment of the present invention.
Figure 21:
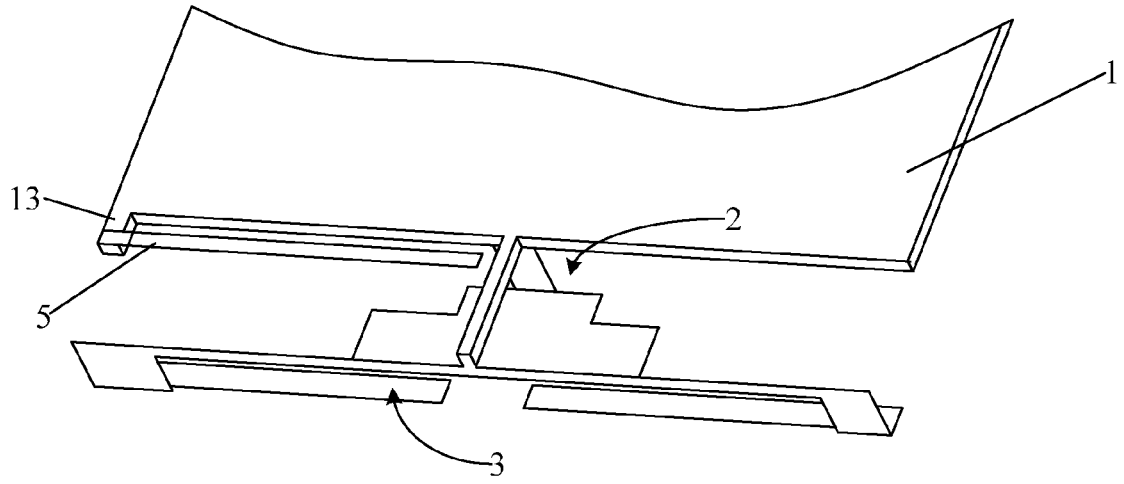
FIG. 21 is a fourth schematic structural diagram of the fifth multimode broadband antenna module according to an embodiment of the present invention.

In addition, as shown in FIG. 20 or FIG. 21, when the setting area is relatively large, the third radiator 5 may have a straight stripe structure.

Generally, the third radiator 5 or even the entire multimode broadband antenna module is attached onto an antenna support disposed in a wireless terminal, and the third radiator 5 is disposed in a place in another structure far from the multimode broadband antenna module, so as to prevent signal interference between radiators. If an area reserved on the antenna support cannot meet a requirement of the third radiator 5, another end of the third radiator 5 may be extended to be attached onto an insulating case body of the wireless terminal.

Figure 22:
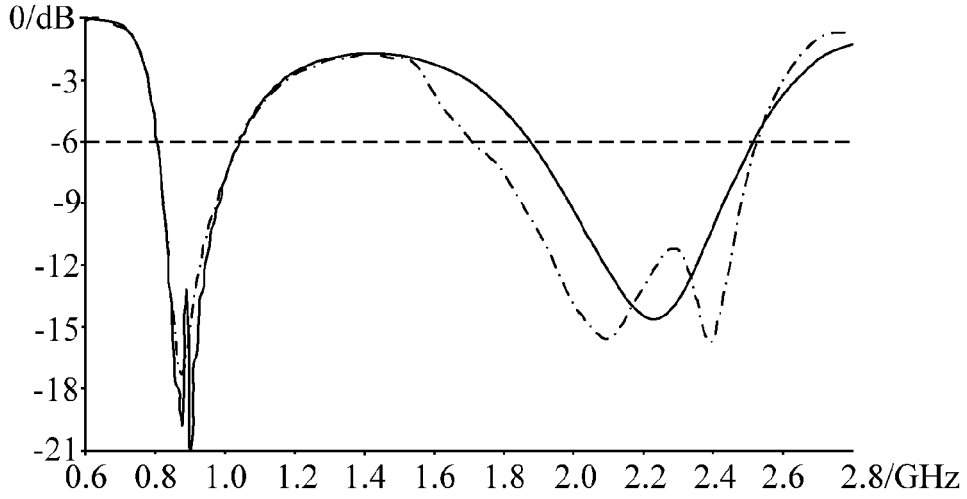
FIG. 22 is a simulation comparison diagram of return loss of the third multimode broadband antenna module and return loss of the fifth multimode broadband antenna module according to an embodiment of the present invention.

Because the third radiator 5 shown in FIG. 18 and FIG. 19 or FIG. 20 and FIG. 21 is disposed closely to the high frequency portion 23 of the first radiator, it can be seen from comparison between a return loss curve (the dot-dash line) of the fifth multimode broadband antenna module and a return loss curve (the solid line) of the third multimode broadband antenna module in FIG. 22 that, a high frequency working bandwidth of the fifth multimode broadband antenna module is larger than a high frequency working bandwidth of the third multimode broadband antenna module, which indicates that the third radiator 5 can effectively broaden a working bandwidth of an antenna, so that the multimode broadband antenna module shown in FIG. 18 and FIG. 19 or FIG. 20 and FIG. 21 can better meet a use requirement of different users for a working frequency band of an antenna module.

It should be noted that, the connection portion 21 of the first radiator 2 of the foregoing various multimode broadband antenna modules may have a planar plate structure or a stripe structure. The connection portion 21 has a conduction function; and therefore, when the connection portion 21 of the first radiator 2 has a planar plate structure, a thickness of the planar plate structure can be randomly set, or even a thickness of the planar plate structure can be reduced to make it approximate to a plane. Similarly, a thickness and a width of the stripe structure can also be randomly set, and the thickness and the width of the stripe structure can be reduced to make the stripe structure approximate to a conducting wire.

Similarly, the grounding portion 31 of the second radiator 3 of the foregoing various multimode broadband antenna modules may also have a planar plate structure or a stripe structure. The grounding portion has a conduction function; and therefore, when the grounding portion 31 of the second radiator 3 has a planar plate structure, a thickness of the planar plate structure can be randomly set, or even a thickness of the planar plate structure can be reduced to make it approximate to a plane. Similarly, a thickness and a width of the stripe structure can also be randomly set, and the thickness and the width of the stripe structure can be reduced to make the stripe structure approximate to a conducting wire.

When a user uses a wireless terminal such as a mobile phone to make a call, because the brain of the user is close to an antenna module of the wireless terminal, transmission and reception performance of the wireless terminal is reduced, so that transmission and reception performance for radiation of the entire wireless terminal is reduced. In a process of researching and developing a wireless terminal, technical personnel related in the research and development quantitatively measure an impact of a human brain on transmission and reception performance of the wireless terminal, and optimally design the wireless terminal, so as to reduce the impact of the human brain on the transmission and reception performance of the wireless terminal, that is, reduce electromagnetic coupling between a human body and an antenna module.

In addition, when a user uses a wireless terminal such as a mobile phone, the user always changes a hand for holding the wireless terminal, and an impact of the left hand on transmission and reception performance of the wireless terminal when the user uses the left hand to hold the wireless terminal may be different from an impact of the right hand on the transmission and reception performance of the wireless terminal when the user uses the right hand to hold the wireless terminal. When the transmission and reception performance of the wireless terminal is greatly affected, a communication capability of the wireless terminal may be reduced, and user experience of the user for the wireless terminal is reduced.

In the embodiment of the present invention, the signal feeding end may be set at a middle position of an edge of the printed circuit board, so that signal receiving and sending capabilities of the wireless terminal are not greatly affected no matter whether the user uses the left hand or the right hand to hold the wireless terminal, and the user experience of the user is better, that is, the wireless terminal has a better head-hand simulation effect.

Further, the first radiator 2 or the second radiator 3 of the foregoing third multimode broadband antenna module and fourth multimode broadband antenna module has a symmetrical structure, which not only reduces a process requirement but further improves the head-hand simulation effect of the wireless terminal.

Generally, a clearance area occupied by the various multimode broadband antenna modules provided in the embodiment of the present invention is 60 millimeters long, 10 millimeters wide, and 5 millimeters high. The length of the clearance area is equal to a side length of the multimode broadband antenna module disposed on the printed circuit board 1, and the other side length of the printed circuit board 1 is about 100 millimeters.

It should be noted that, the low frequency portion 22 and the high frequency portion 23 of the first radiator of the foregoing first multimode broadband antenna module, third multimode broadband antenna module, and fourth multimode broadband antenna module may be designed and combined by oneself as required. Similarly, the low frequency portions 32 and the high frequency portions 33 of the second radiator of the foregoing first multimode broadband antenna module, third multimode broadband antenna module, and fourth multimode broadband antenna module may be designed and combined by oneself as required, and whether the third radiator 5 needs to be disposed may also be selected as required.

Embodiment 3

Figure 23:
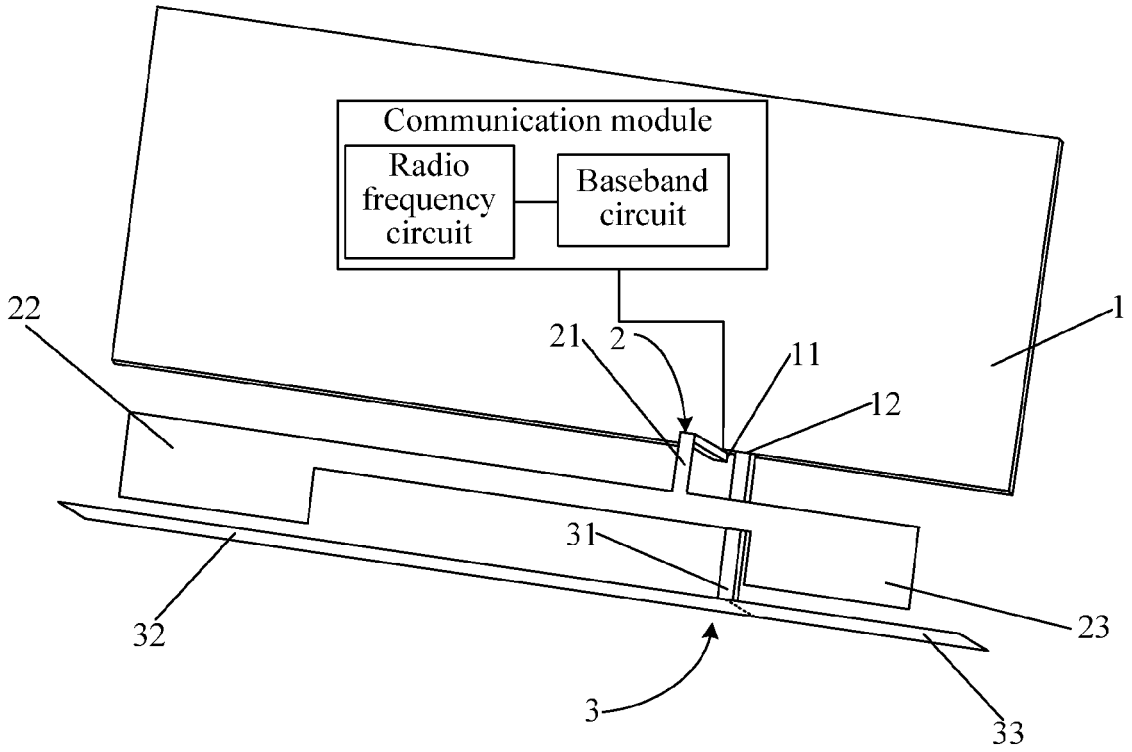
FIG. 23 is a schematic structural diagram of a wireless terminal according to an embodiment of the present invention.

An embodiment of the present invention provides a wireless terminal, including a multimode broadband antenna module and a case body, where the multimode broadband antenna module is disposed in the case body. As shown in FIG. 23, the multimode broadband antenna module includes a printed circuit board 1, a first radiator 2, and a second radiator 3, where the first radiator 2 includes a connection portion 21, a low frequency portion 22, and a high frequency portion 23, where the low frequency portion 22 of the first radiator is connected to the high frequency portion 23 of the first radiator, and one end of the connection portion 21 of the first radiator is connected to a joint between the low frequency portion 22 and the high frequency portion 23 of the first radiator, and the other end is electrically connected to a signal feeding end 11 of the printed circuit board 1; and the second radiator 3 includes a grounding portion 31, a low frequency portion 32, and a high frequency portion 33, where the low frequency portion 32 of the second radiator is connected to the high frequency portion 33 of the second radiator, and one end of the grounding portion 31 of the second radiator is connected to a joint between the low frequency portion 32 and the high frequency portion 33 of the second radiator, and the other end is electrically connected to a first grounding end 12 of the printed circuit board 1.

As shown in FIG. 23, the three: the first radiator 2, the second radiator 3, and the printed circuit board 1 form the multimode broadband antenna module together. A communication signal of a wireless terminal is transmitted and received through the multimode broadband antenna module.

When the wireless terminal transmits a signal, the communication signal is processed by a communication module that is disposed on the printed circuit board 1 and formed by a radio frequency circuit and a baseband circuit, and is converted into a high frequency current, and the high frequency current enters the antenna module through the signal feeding end 11 on the printed circuit board 1, and then is radiated in the form of an electromagnetic wave.

When the wireless terminal receives a signal, an electromagnetic wave signal from an outer space of the wireless terminal is received by the multimode broadband antenna module and is converted into a high frequency current, and enters, through the signal feeding end 11 of the printed circuit board 1, a communication module that is disposed on the printed circuit board 1. The communication module is mainly formed by a radio frequency circuit and a baseband circuit, so that communication can be normally performed.

It should be noted that, a first predetermined distance exists between the low frequency portion 22 of the first radiator and the low frequency portion 32 of the second radiator, and a second predetermined distance exists between the high frequency portion 23 of the first radiator and the high frequency portion 33 of the second radiator, so as to form a coupling capacitance effect between the first radiator and the second radiator, where the first predetermined distance and the second predetermined distance both need to be designed and adjusted according to an actual situation, and the two may be the same or may be different.

In the prior art, an antenna module generally includes only a printed circuit board 1 and a first radiator 2. When the antenna module includes only the printed circuit board 1 and the first radiator 2, in this case, a working frequency band of the antenna module is decided by electrical lengths of a high frequency portion 23, a low frequency portion 22, and a connection portion 21 of the first radiator of the antenna module. Specifically, a sum of the electrical length of the high frequency portion 23 and the electrical length of the connection portion 21 of the antenna module is a quarter of a high frequency resonance wavelength of the antenna module. Similarly, a sum of the electrical length of the low frequency portion 22 and the electrical length of the connection portion 21 of the antenna module is a quarter of a low frequency resonance wavelength of the antenna module. In this case, the antenna module can only work around a resonance frequency corresponding to the high frequency resonance wavelength and a resonance frequency corresponding to the low frequency resonance wavelength. Obviously, in this case, a working bandwidth of the multimode broadband antenna module is relatively small.

Specifically, as shown in FIG. 2, the electrical length of the high frequency portion 23 of the first radiator is a+b, and the electrical length of the connection portion is f+c, so that the high frequency resonance wavelength of the first radiator 2 is 4*[(a+b)+(f+c)]. Similarly, the electrical length of the low frequency portion 22 of the first radiator is d+e, so that the low frequency resonance wavelength of the first radiator 2 is 4*[(d+e)+(f+c)].

In addition to the printed circuit board 1 and the first radiator 2, the multimode broadband antenna module in the embodiment of the present invention further includes the second radiator 3, and the low frequency portion 22 of the first radiator is close to the low frequency portion 32 of the second radiator, and the high frequency portion 23 of the first radiator is close to the high frequency portion 33 of the second radiator. Because the low frequency portion 32 of the second radiator is close to the low frequency portion 22 of the first radiator, when a low frequency signal exists on the low frequency portion 22 of the first radiator, the low frequency portion 22 of the first radiator and the low frequency portion 32 of the second radiator form a coupling capacitance effect, so as to motivate a high-order mode, thereby broadening a working frequency band of the multimode broadband antenna module and enlarging a working frequency range.

Similarly, because the high frequency portion 33 of the second radiator is close to the high frequency portion 23 of the first radiator, when a high frequency signal exists on the high frequency portion 23 of the first radiator, the high frequency portion 23 of the first radiator and the high frequency portion 33 of the second radiator form a coupling capacitance effect, so as to motivate a high-order mode, thereby broadening the working frequency band of the multimode broadband antenna module and enlarging the working frequency range.

It should be noted that, because a working principle of the multimode broadband antenna module is that a working bandwidth of the antenna module is broadened based on a coupling capacitance effect between the first radiator 2 and the second radiator 3, a thickness of the multimode broadband antenna module can be designed and adjusted according to specific architecture and a thickness requirement of the wireless terminal; however, relevant technical personnel need to strictly adjust a distance between parts of the first radiator 2 and the second radiator 3, so as to enable the multimode broadband antenna module to work at a working frequency that meets a multimode condition.

Generally, when the wireless terminal has a strict requirement for the thickness of the multimode broadband antenna module, under the premise of meeting a radiation index of the multimode broadband antenna module, an overall thickness of the multimode broadband antenna module can be controlled to be about 4 to 5 millimeters, so that a thickness of the wireless terminal disposed with the multimode broadband antenna module can be reduced, and finally, the thickness of the wireless terminal is less than 1 centimeter, which conforms to a tendency that the wireless terminal becomes light and thin.

Further, the working frequency band of the multimode broadband antenna module can be adjusted by only adjusting lengths of the first radiator 2 and the second radiator 3 or a distance between the first radiator 2 and the second radiator 3, so that a thickness of the first radiator 2 or a thickness of the second radiator 3 of the multimode broadband antenna module can be randomly set, and the thickness of the first radiator 2 or the thickness of the second radiator 3 can be reduced as much as possible, so as to reduce material usage of the first radiator 2 or the second radiator 3 in a manufacturing process. Similarly, a width of the first radiator 2 and a width of the second radiator 3 can also be randomly set to further reduce the material usage of the first radiator 2 or the second radiator 3.

When a user uses a wireless terminal such as a mobile phone to make a call, because the brain of the user is close to an antenna module of the wireless terminal, transmission and reception performance of the wireless terminal is reduced, so that transmission and reception performance for radiation of the entire wireless terminal is reduced. In a process of researching and developing a wireless terminal, technical personnel related in the research and development quantitatively measure an impact of a human brain on transmission and reception performance of the wireless terminal, and optimally design the wireless terminal, so as to reduce the impact of the human brain on the transmission and reception performance of the wireless terminal, that is, reduce electromagnetic coupling between a human body and an antenna module.

In addition, when a user uses a wireless terminal such as a mobile phone, the user always changes a hand for holding the wireless terminal, and an impact of the left hand on transmission and reception performance of the wireless terminal when the user uses the left hand to hold the wireless terminal may be different from an impact of the right hand on the transmission and reception performance of the wireless terminal when the user uses the right hand to hold the wireless terminal. When the transmission and reception performance of the wireless terminal is greatly affected, a communication capability of the wireless terminal may be reduced, and user experience of the user for the wireless terminal is reduced.

In the embodiment of the present invention, the signal feeding end may be set at a middle position of an edge of the printed circuit board, so that signal receiving and sending capabilities of the wireless terminal are not greatly affected no matter whether the user uses the left hand or the right hand to hold the wireless terminal, and the user experience of the user is better, that is, the wireless terminal has a better head-hand simulation effect.

Generally, a clearance area occupied by the multimode broadband antenna module provided in the embodiment of the present invention is 60 millimeters long, 10 millimeters wide, and 5 millimeters high. The length of the clearance area is equal to a side length of the multimode broadband antenna module disposed on the printed circuit board 1, and the other side length of the printed circuit board 1 is about 100 millimeters.

Further, the multimode broadband antenna module in the wireless terminal has multiple specific structures. For details, reference is made to the description in Embodiment 2, which are not described herein again.

In the technical solution in the embodiment of the present invention, a wireless terminal is provided, where a multimode broadband antenna module is disposed in a case body of the wireless terminal, and the multimode broadband antenna module includes a printed circuit board, a first radiator, and a second radiator. A working principle of the multimode broadband antenna module is that a coupling capacitance effect is formed between the first radiator and the second radiator, so as to motivate a high-order mode, thereby broadening a working frequency of the multimode broadband antenna module; and furthermore, a thickness of the multimode broadband antenna module is relatively small, so that a requirement for a thin structure of a wireless terminal such as a mobile phone is met.

The foregoing descriptions are merely specific embodiments of the present invention, but are not intended to limit the protection scope of the present invention. Any variation or replacement readily figured out by a person skilled in the art within the technical scope disclosed in the present invention shall all fall within the protection scope of the present invention. Therefore, the protection scope of the present invention shall be subject to the protection scope of the claims.

What is claimed is:

1. A multimode broadband antenna module, comprising:

a printed circuit board;

a first radiator; and a second radiator, wherein the first radiator comprises a connection portion, a low frequency portion, and a high frequency portion, wherein the low frequency portion of the first radiator is connected to the high frequency portion of the first radiator, and a first end of the connection portion of the first radiator is connected to a joint between the low frequency portion and the high frequency portion of the first radiator, and a second end of the connection portion of the first radiator is electrically connected to a signal feeding end placed on the printed circuit board, wherein the second radiator comprises a grounding portion, a low frequency portion, and a high frequency portion, wherein the low frequency portion of the second radiator is connected to the high frequency portion of the second radiator, and a first end of the grounding portion of the second radiator is connected to a joint between the low frequency portion and the high frequency portion of the second radiator, and a second end of the connection portion of the first radiator is electrically connected to a first grounding end placed on the printed circuit board, wherein a first predetermined distance exists between the low frequency portion of the first radiator and the low frequency portion of the second radiator, and a second predetermined distance exists between the high frequency portion of the first radiator and the high frequency portion of the second radiator to form a coupling capacitance effect between the first radiator and the second radiator, wherein the connection portion of the first radiator has a planar plate structure or a strip structure, and the grounding portion of the second radiator has a planar plate structure or a strip structure, wherein the low frequency portion and the high frequency portion of the first radiator are symmetrically distributed at two sides of the joint between the two, and the low frequency portion and the high frequency portion of the first radiator form a planar T-shaped plate structure or a straight strip structure together, wherein the low frequency portion and the high frequency portion of the second radiator are symmetrically distributed at two sides of the joint between the two, and the low frequency portion and the high frequency portion of the second radiator each has a strip structure or a plate structure, wherein the strip structure or the plate structure extends for a distance from the joint between the two and is bent towards a direction of the first radiator, and wherein an opening formed by a bend of the low frequency portion of the second radiator is opposite to an opening formed by a bend of the high frequency portion of the second radiator, wherein at least one part of the low frequency portion and the high frequency portion of the second radiator is located in the same plane with the first radiator, and an angle of 90 degrees exists between the part of the low frequency portion of the second radiator that is located in the same plane with the first radiator and another part of the low frequency portion of the second radiator, and wherein the part of the low frequency portion of the second radiator that is located in the same plane with the first radiator is one end which is bent towards the first radiator, and the part of the high frequency portion of the second radiator that is located in the same plane with the first radiator is one end which is bent towards the first radiator.

2. The multimode broadband antenna module according to claim 1, further comprising a third radiator, wherein the third radiator has a strip structure having at least one bend or a straight strip structure, and one end of the third radiator is connected to a second grounding end placed on the printed circuit board.

3. A wireless terminal, comprising:

a multimode broadband antenna module; and a case body, wherein the multimode broadband antenna module is disposed in the case body, and the multimode broadband antenna module comprises a printed circuit board, a first radiator, and a second radiator, wherein the first radiator comprises a connection portion, a low frequency portion, and a high frequency portion, wherein the low frequency portion of the first radiator is connected to the high frequency portion of the first radiator, and a first end of the connection portion of the first radiator is connected to a joint between the low frequency portion and the high frequency portion of the first radiator, and a second end of the connection portion of the first radiator is electrically connected to a signal feeding end placed on the printed circuit board, wherein the second radiator comprises a grounding portion, a low frequency portion, and a high frequency portion, wherein the low frequency portion of the second radiator is connected to the high frequency portion of the second radiator, and a first end of the grounding portion of the second radiator is connected to a joint between a low frequency signal and a high frequency signal of the second radiator, and a second end of the grounding portion of the second radiator is electrically connected to a first grounding end placed on the printed circuit board, wherein a first predetermined distance exists between the low frequency portion of the first radiator and the low frequency portion of the second radiator, and a second predetermined distance exists between the high frequency portion of the first radiator and the high frequency portion of the second radiator to form a coupling capacitance effect between the first radiator and the second radiator, wherein the connection portion of the first radiator has a planar plate structure or a strip structure, and the grounding portion of the second radiator has a planar plate structure or a strip structure, wherein the low frequency portion and the high frequency portion of the first radiator are symmetrically distributed at two sides of the joint between the two, and the low frequency portion and the high frequency portion of the first radiator form a planar T-shaped plate structure or a straight strip structure together, wherein the low frequency portion and the high frequency portion of the second radiator are symmetrically distributed at two sides of the joint between the two, and the low frequency portion and the high frequency portion of the second radiator each has a strip structure or a plate structure, wherein the strip structure or the plate structure extends for a distance from the koint between the two and is bent towards a direction of the first radiator, and an opening formed by a bend of the low frequency portion of the second radiator is opposite to an opening formed by a bend of the high frequency portion of the second radiator, wherein at least one part of the low frequency portion and the high frequency portion of the second radiator is located in the same plane with the first radiator, and an angle of 90 degrees exists between the part of the low frequency portion of the second radiator that is located in the same plane with the first radiator and another part of the low frequency portion of the second radiator, and wherein the part of the low frequency portion of the second radiator that is located in the same plane with the first radiator is one end which is bent towards the first radiator, and the part of the high frequency portion of the second radiator that is located in the same plane with the first radiator is one end which is bent towards the first radiator.

4. The wireless terminal according to claim 3, wherein the multimode broadband antenna module further comprises a third radiator, wherein the third radiator has a bent strip structure or a straight strip structure, and one end of the third radiator is connected to a second grounding end placed on the printed circuit board.

* * * * *